US005540168A

United States Patent [19]

Pettus

[11] Patent Number: 5,540,168

[45] Date of Patent: Jul. 30, 1996

[54] CATAMARAN SAILBOAT EXTENSION WING WITH VOLUMETRIC FRAME

[76] Inventor: Norman E. Pettus, 16 Village Dr., Ledyard, Conn. 06339

[21] Appl. No.: 503,833

[22] Filed: Jul. 18, 1995

[51] Int. Cl.[6] ..... B63B 35/00

[52] U.S. Cl. ..... 114/39.1; 114/61

[58] Field of Search ..... 114/61, 39.1, 123

[56] References Cited

U.S. PATENT DOCUMENTS

| | | | |
|---|---|---|---|
| 3,862,456 | 1/1975 | Fisher et al. | 114/39.1 |
| 4,030,436 | 6/1977 | Stöberl | 114/39.1 |
| 4,646,669 | 3/1987 | Frank | 114/39.1 |
| 4,662,298 | 5/1987 | Strahle | 114/61 |
| 5,060,591 | 10/1991 | Ciavarra | 114/39.1 |

OTHER PUBLICATIONS

Hobie Catalog 1995–1996, p. 26.

*Primary Examiner*—Jesus D. Sotelo

[57] ABSTRACT

A sailboat is provided with an outboard-projecting elevated attachment or extension wing constructed of large-diameter frame tube elements used in combination for storage, seating, buoyant righting assist, and outboard leveraging of weight or trapezing. Design strength is sufficient to support an aft-extending tube allowing a trapezing sailor to counterbalance forward pitching motion. Design strength also allows outboard extending tube elements to support the weight of the boat in a shallow-water upset. Stresses are distributed to the extent that low-cost, low maintenance plastic can be used for frame tube elements. Broad, large-diameter plastic surfaces are comfortable in contact with the skin, provide secure footing for trapezing, and have reduced tendency to bruise a trapezing sailor in an upset. Internal storage within frame tube elements is supplemented by means for secure outboard attachment of watertight coolers at convenient and conformal locations. Available insulated and un-insulated storage supports use of the catamaran for day-sailing purposes, and a comfortable trap seat reduces sailor fatigue. No drilling or machining of the existing catamaran is required when installed on a Hobie-16 catamaran. Two embodiments are described, supporting slide-in/slide-out and foldable stowage and deployment provisions, respectively. Both embodiments permit convenient trailering of the catamaran. A dual-tiller extension pole assembly operates with the extension wing to relieve tiller extension pole handling difficulties prevalent in small catamarans, and particularly prevalent in small catamarans modified for day-sailing by the inclusion of an aft-mounted motor.

17 Claims, 14 Drawing Sheets

CATAMARAN SAILBOAT EXTENSION WING WITH VOLUMETRIC FRAME

BACKGROUND

1. Field of the Invention

The present invention relates to an attachment for the simultaneous improvement of comfort, performance, ease of use, storage capacity, and righting ability in a small catamaran sailboat. More specifically, the present invention relates to an outboard-projecting elevated attachment or extension wing for a small catamaran sailboat that provides a combination of comfortable seating, windward counterbalancing, simplified tiller handling, integral watertight storage, and improved fighting leverage.

2. Description of Prior Art

Small catamaran sailboats have limited storage capacity and can tax the endurance of a sailor by requiting constant manual tensioning of sheet ropes and leveraging against sailboat heeling motion. With only a centrally-disposed "trampoline" as primary seating accommodations, small catamaran sailboats are also relatively uncomfortable. They are also more difficult to tack and control than small mono-hull sailboats and are substantially more difficult to right after an upset. The lack of substantial watertight storage is another concern since an accidental upset may lead to the immersion of stored items, and since sprayed water is common under all but the most benign sailing circumstances. If the small catamaran sailboat is used for a day-sailing excursion, or for camping, stored items may include towels, blankets, extra clothing, and a variety of picnic supplies which should preferentially be kept dry.

Independent aftermarket products address each of these problems, demonstrating a long felt need in each area of concern. Watertight cubby-hole installation kits and container-mounting gear improve onboard storage capacity, for example. An available aftermarket mast float promotes righting ability by floating the mast tip in case of an upset, thereby preventing a full capsize. A further improvement in righting ability is gained by means of an aftermarket water bag that hangs on a strap from a sailor's shoulder so as to increase applied leverage as the sailor stands on the exposed portion of the floating keel and leans away from the boat, while pulling on a fighting line. Improved sailboat performance results when the sailor employs a special body harness to hang outboard with feet against the hull or superstructure. This process, known as "trapezing", allows the sailor to more effectively counterbalance sailboat heeling force by transforming it into additional forward thrust.

Tiller-handling is also cumbersome when tacking a small catamaran sailboat due to the presence of a relatively complex rudder assembly consisting of two rudders with two tillers, one filler extending forward from each rudder, with the forward ends of the tillers connected by a tiller cross-bar. Since the tiller crossbar is not always in easy reach, a tiller extension pole is normally provided, continuously held at one end by the helmsman and connected at the other end to a pin fie or pivot bolt located at the midpoint of the tiller cross-bar. The tiller extension pole is relatively long and cannot be swung forward over the trampoline and across to the opposite side of the catamaran because of interference with the mainsheet block and tackle system. On small catamaran sailboats, this system of ropes and pulleys generally extends downward from the boom to an aft cross beam that is parallel to, and directly forward of the tiller crossbar. During a tack, the helmsman must typically crouch and shuffle under the boom while at the same time swiveling the tiller extension pole rearward and across, thereby bringing the tiller extension pole around to the opposite side of the catamaran. Since small catamaran sailboats are wider than small mono-hull sailboats and more difficult to tack, the helmsman must also take care to maintain the correct rudder angle during the entire process. An additional disadvantage of this operation is that it causes the helmsman to face aft while shuffling across the boat and manipulating the tiller extension pole. As a result, he temporarily loses sight of the bows of his catamaran as well as his forward wind direction indicators. If his frame of reference is momentarily disturbed, under-steering or over-steering may result, or he may fail to act in a timely fashion to assist the tack by adjusting sails so as to "weather vane" the bows of the boat across the eye of the wind.

If the small catamaran sailboat is outfitted for a day-sailing excursion to a location some distance away from the launch point, it is desirable to mount a small motor as backup propulsion in case the wind should subside. In a common installation, this motor is mounted on a strut which projects rearward from the catamaran's aft cross beam. When sailing, the motor strut pivots upward to lift the propeller clear of the wave tops, while at the same time allowing the sailboat boom to swing over and past the motor during a tack. With the motor present, handling of the tiller extension pole is doubly cumbersome, since the tiller extension pole must be swung rearward, lifted over the motor, and then lowered to pass under the boom. Since the boom typically swings directly aft during a tacking process, it is often necessary to shove the boom clear with one hand while guiding the tiller extension pole with the remaining hand.

Due to their wide beam, the turning rate of small catamaran sailboats is substantially less than that of a small mono-hull sailboats. With the cumbersome handling of the tiller extension pole further compounding the problem, failed or poorly perforated tacks are common in small catamaran sailboats. To assist sailing a steady heading and/or trapezing, an existing telescoping tiller extension pole is available to improve tiller handling. No device is known, however that substantially reduces the amount of tiller extension pole handling imposed on the helmsman during a tacking process.

With respect to the above noted issues of small catamaran sailboat comfort, performance, ease of use, storage capacity, and righting ability; only comfort and performance are substantially affected by the installation of an existing extension wing or outboard seat design. The term "extension wing" in this context refers to an outboard-projecting elevated attachment of sufficient strength to support trapezing. An extension wing may also provide seating, but the term "outboard seat" used herein, refers specifically to outboard-projecting elevated attachments that provide seating but cannot support trapezing. All outboard-projecting elevated attachments described herein are distinct from out-rigged pontoons or floats in that they are normally elevated over the surface of the water, thereby causing a substantially smaller increase in the catamaran sailboat's waterline perimeter, wetted surface area, and hydrodynamic drag, as compared to an out-rigged pontoon of similar weight.

Existing outboard seating devices include that described by U.S. Pat. No. 4,662,298 to Strahle for a small catamaran and an aftermarket outboard seat for the East Coast Catamaran Inc. Hobie 16 Model. The Hobie 16 Seat is wider and more rugged than the Strahle Seat and has the additional advantage of folding inboard for trailering of the sailboat.

Both seats tend to place a sailor's weight outboard, but not to the same degree as that accomplished by trapezing from the catamaran's existing trampoline support rail. As a result, any performance benefit associated with these outboard seat designs is less than that provided by trapezing.

Certain catamaran sailboats such as the Hobie 17 Model, also produced by East Coast Catamaran Inc., have specially designed hulls providing for outboard extension wings sold as an integral part of the sailboat. The Hobie 17 extension wing design provides an outboard bench seat consisting of fabric stretched across a frame of aluminum tube. Although not as comfortable as outboard seats that provide reclined seating, the Hobie 17 extension wing improves boat performance by enhancing the effectiveness of trapezing. This is because it provides an outboard "trapeze rail" or elevated support rail that is substantially aligned with the direction of sailboat travel, so as to support the trapezing sailor in a more outboard position as he stands with feet spread apart, leans backward, and leverages his weight against sailboat heeling force.

Outboard seat devices as described above address the issue of comfortable seating, but are substantially less effective than trapezing as a means of providing enhanced performance. Extension wing devices such as the Hobie 17 model described above, provide enhanced performance but do not provide reclined seating. Regardless of their varying degrees of success with respect to the areas of (1) comfortable seating and (2) performance, these designs provide little benefit with respect to the remaining issues of (3) ease of use, (4) watertight storage capacity, and (5) righting ability. Moreover, they fail to address the above five concerns in an integrated and complimentary fashion. As a result, a variety of disadvantages and lost opportunities will entail after the installation of one of the above described outboard seat or extension wing designs on a small catamaran sailboat, as summarized below.

(a) An outboard seating device can directly impede the practice of trapezing. The Strahle and Hobie 16 outboard seats, for example, do not provide secure footing for trapezing from their outboard-projecting elevated structure, and block access to existing footing that would be used for trapezing.

(b) Outboard seats such as the Strahle device are fragile in comparison to existing hull and superstructure elements, and being mounted in a necessarily exposed position, are particularly susceptible to damage. Under certain unplanned circumstances, for example, an outboard seat may act as "bumper" between the catamaran and other objects. The risk of damage is substantial when docking since forceful impact of the dock against the outboard structure may occur. The outboard seat may also be subject to damage resulting from an accidental upset of the catamaran in shallow water or on the beach.

(c) Hobie 17-type extension wing devices provide an elevated support rail of relatively small cross-section. Trapezing on an elevated rail is inherently less stable due to amplified heeling and pitching motions, and a broad surface for secure footing would be more desirable. Small cross-section framework elements are also more likely to bruise the sailor in the event of a spill.

(d) Hobie 17-type extension wing devices do not provide reclined seating. Sitting in a bench seat with no back support, the sailor will frequently lean backwards to pull against the filler extension pole and/or sheet ropes. Since these are variable loads, the sailor will also perform frequent "sit-up" motions so as to re-assume an erect sitting position. Due to this kind of activity, increased fatigue results during a full day of sailing.

(e) Outboard seats and extension wings on the downwind side should preferably clear the water when the catamaran reaches a heeling attitude associated with its peak performance. Devices such as the Strahle and Hobie 16 outboard seats do not satisfy this goal due to their use of supporting struts that connect to the hull in an area frequently subject to the action of passing waves. A simpler structure, attached at a minimum number of points, and eliminating struts such as these would be preferable.

(f) Known outboard seats or extension wings do not support moving crew weight farther aft for improved counterbalancing against forward pitching motion. This is a particular disadvantage for sailboats such as the Hobie 16 Catamaran, which have a performance-limiting tendency to pitch forward, submarining the downwind bow. To counteract this tendency without slowing the boat, the crew must transfer their weight as far aft as possible. Nevertheless, conditions frequently require adjustment of the sails to release more wind, thereby slowing down the boat.

(g) Known extension wing designs and outboard seats similar to the Strahle design do not provide significant internal floatation when submerged by an upset of the sailboat and therefore do little to enhance sailboat fighting characteristics. Should an externally attached container fill with water after a capsize, righting ability may be degraded.

(h) Known extension wings and outboard seats do not provide integral watertight storage, disposed within, and conformal to the frame elements of their outboard-extending structure. Increased reliance on outboard externally-attached containers results, but such containers are difficult to securely attach, and incur additional drag for each container employed.

(i) Known extension wings and outboard seats do not integrally provide insulated storage for drinks. Since insulated storage space is in short supply on small catamaran sailboats, space required for the provision of drinks typically leaves little room for the insulated storage of food. Increased reliance on externally attached coolers results, and these coolers must compete for space with outboard watertight containers noted in (h) above.

(j) Known extension wing and outboard seat designs do not incorporate integral provisions to mount an outboard watertight container for easy accessibility, in a location that allows the structure of the wing to mitigate the direct impact of water in a capsize. A container can be jury-rigged or strapped to a known extension wing or outboard seat, but a substantial impact and water intrusion can result when excessive heeling occurs, dipping the container and its supporting structure into the water. Under such conditions, an outboard-mounted container can easily be jarred loose.

(k) Considerations noted in (h), (i), and (j) above also cause increased reliance on inboard-mounted containers. Suitable locations for inboard mounting of containers are rare however, since most areas on a small catamaran sailboat are worked by the crew or are subject to the impact of occasional waves. A small catamaran sailboat fitted with an existing wing or outboard seat design will therefore have limited options for the provision of blankets, towels, extra clothing, food, drinks, and the variety of items desirable for camping or a full day of touring activity.

(l) No known extension wing or outboard seat employs frame-member geometry which distributes force to the extent that low-cost plastic or other non-metallic material can advantageously be used as a principal structural material. In particular, no known extension wing or outboard seat employs wing mounting gear which distributes force to the extent that such non-metallic frame elements are securely held without substantial damaging deformation when unexpectedly called upon to support the weight of the sailboat, such as after a capsize in shallow water or on the beach. All known structures capable of similar strength employ wing mounting gear which necessitate that the outboard-extending wing structure employ a balance of metallic members. In comparison with non-metallic members such as plastic, metallic members are less comfortable in contact with the skin, and are more susceptible to corrosion.

(m) With the exception of the Hobie 16 seat, all known aftermarket outboard seating devices and wings require installation by drilling of holes into existing sailboat structural elements. Possible problems associated with such modifications include; 1) additional required time, expertise, tools, and labor is imposed on the installing owner; 2) structural weakness may be introduced by drilling of holes in load-bearing components; 3) damage to the existing sailboat may result from improper installation; and, 4) additional labor is required if add-on equipment must be removed so as to restore the boat to class-legal status for participation in sailing club racing activities.

(n) Tiller extension pole handling and associated tacking operations are cumbersome on existing catamaran sailboat designs. If a motor is installed, the handling of the tiller extension pole becomes additionally cumbersome. As a result, experimentation intended to find the correct tiller angle for tacking in a certain wind condition is difficult, primarily because the tiller angle will vary due to required manual manipulations of the tiller extension pole. No existing extension wing or outboard seat design is known that integrally operates with a tiller assembly so as to alleviate these difficulties, thereby enhancing a catamaran sailboat's overall ease of use.

(o) Because of the various deficiencies of small catamaran sailboats with respect to storage capability and ease of use, their application for several-hour excursions or day-sailing is compromised. In fact, most recreational sailors interested in day-sailing excursions will typically choose a small mono-hull sailboat over a small catamaran sailboat, despite the fact that catamarans are faster and should therefore have a wider range. Although existing extension wing and outboard seat designs do provide improved comfort, they do not integrally address ease of use and storage issues. As a result, most small catamaran sailboats have an image of providing high-performance but low-habitability, and are not viewed as a practical alternative for comfortable day-sailing.

In summary, no functional combination comprising a small catamaran sailboat and an outboard seat or extension wing is known that simultaneously enhances the catamaran's capability in the areas of comfort, performance, ease of use, watertight storage capacity, and righting ability. Known outboard seat or extension wing designs also fail to incorporate features that act in complimentary or synergistic fashion to remedy the several disadvantages noted above. The above discussed Strahle outboard seat, for example, entails all of the above disadvantages except (c), and (d), which apply to extension wings. The Hobie 16 Seat, is more rugged than the Strahle Seat, does not require modification of the sailboat, and has outboard foam cushions that assist the righting process. The Hobie 16 Seat is nevertheless subject to disadvantages (a), (e), (f), (h), (i), (j), (k), (l), (n), and (o). In comparison with the present invention, the Hobie 17 Wing entails all of the above noted disadvantages except (a), (b), and (e), with disadvantage (m) being inapplicable only because a Hobie 17-type wing is not offered as an aftermarket add-on for other small catamarans.

OBJECTS AND ADVANTAGES

It is among the objects of the present invention to specifically address and remedy each of the disadvantages described above. In particular the present invention will;

(a) Provide an extension wing design that advantageously locates outboard elevated support rails so as to enhance the effectiveness of trapezing.

(b) Employ a design that incorporates sufficient structural strength to support the weight of the catamaran in the event of an accidental capsize on land or in shallow water.

(c) Provide broad footing surfaces that improve the traction and stability of the trapezing sailor, and reduce the possibility of bruising the sailor in the event of a spill.

(d) Provide reclined, comfortable seating that reduces fatigue over a full day of sailing.

(e) Minimize the number of wing attachment points and avoid the use of struts or members that attach to the hull in areas frequented by wave action.

(f) Provide a means for transferring crew weight farther aft, so as to prevent the downwind bow structure from submarining, when trimming the boat for maximum speed.

(g) Improve applied beneficial righting leverage when one wing is submerged.

(h) Reduce the required number of drag-inducing, externally-attached storage containers by providing watertight storage disposed within, and conformal to the outboard-extending wing structure.

(i) Employ the internal volume of a structural wing member for the complimentary purpose of providing conformal watertight-insulated storage for drinks.

(j) Provide integral attachment provisions for mounting of watertight-insulated storage containers in outboard locations that; 1) allow the containers to be used as additional seating surfaces, and 2) allow wing frame elements to substantially shield the containers from a damaging water impact during a capsize.

(k) Without reliance on inboard-mounted containers that interfere with catamaran sailboat operations, provide capacity sufficient for storage of food, drinks, towels, blankets, extra clothing, tools, and the variety of items desirable for a day-sailing excursion, or for camping.

(l) Employ outboard frame elements constructed of corrosion proof, inexpensive plastic or non-metallic material that requires little or no maintenance and is comfortable in contact with the skin.

(m) Minimize permanent modifications to the existing catamaran sailboat. In the specific case of the Hobie 16 catamaran for example, require no cutting, welding, grinding, or drilling of the catamaran hulls or existing aluminum superstructure.

(n) Make the catamaran sailboat easier to use by incorporating tiller assembly modifications that; 1) eliminate the need to swivel the tiller extension rearward to the opposite side of the boat during a tack, and 2) free the helmsman's hands during a tack by allowing him to lock the tiller assembly to an angle that is pre-selected based on tacking conditions, and 3) obviate filler handling problems that result from the installation of a motor in the area of the tiller crossbar.

(o) Allow advantageous use of a catamaran sailboat for day sailing excursions by combining improved catamaran performance with integrally enhanced storage, comfort, and ease of use.

SUMMARY OF THE INVENTION

Disclosed herein is a catamaran sailboat attachment or volumetric extension wing comprising frame-tube elements that provide internally-disposed stowage, accompanied by strength sufficient to support seating, trapezing, externally attached containers, and the weight of the catamaran sailboat during an upset in shallow water or on the beach. The extension wing is formed by an assembly of tubular sections that mount to the catamaran sailboat at two points; one forward and one aft. Tubular support arms extend from the mounting points upwards and outboard, connecting to a tubular elevated support rail, that is substantially oriented in the direction of sailboat travel. The elevated support rail has a main extension tube supported both ends by the tubular support arms and an aft elevated support rail section or aft extension tube projecting rearward from a common connection point with the main extension tube and aft tubular support arm.

Two such extension wings connect to opposite sides of the catamaran sailboat and are essentially mirror images of each other.

Attachment of each wing to the existing catamaran sailboat superstructure is accomplished by a preferred wing mounting gear design that employs low-cost components requiring no special forgings. The disclosed wing mounting gear also requires no alteration of the particular host sailboat involved, in this case a Hobie 16 Catamaran.

Fore and aft wing mounting gear are similar, each employing two vertically projecting mounting struts, that in the present embodiments, are constructed of aluminum bar stock with the shorter (¾-inch) cross-sectional dimension aligned transversely with respect to the catamaran, and the longer (2-inch) cross-sectional dimension longitudinally aligned with the catamaran. Oriented in this fashion, each pair mounting struts is clamped over both sides of a mounting base that comprises a suitably strong hull or superstructure element of the existing catamaran.

With respect to the Hobie 16 catamaran, a forward mounting base is provided by a forward pylon cap fitting that mounts atop a forward corner pylon, which projects vertically from the hull. A second, aft mounting base consists of an aft pylon cap fitting that mounts atop an aft comer pylon, which also projects vertically from the hull. Each pair of mounting struts is sandwiched about its respective mounting base, and a main or lower through bolt secures each assembly by passing through the mounting base and both mounting struts. Since the lower through bolt passes through an existing hole in each mounting base, drilling of a new hole is not required. A second, upper through bolt also extends through both mounting struts but passes over the upper end of the trampoline support pylon cap fitting without penetrating it. Rotation of the mounting struts about their lower through bolt is prevented by clamping action, by the geometry of the pylon cap fitting, and by a stop bushing that is inserted between the upper through bolt shaft and the upper surface of the pylon cap fitting.

At their upward facing ends, each pair of mounting struts incorporates concave surfaces that mate to the underside of a transversely-oriented, inboard-extending tubular mount. In the areas supported by each mounting strut, curved bushing plates are attached to each tubular mount. Each bushing plate acts to distribute concentrated forces without damage to the tubular mount.

Downward clamping of each tubular mount to its support struts is accomplished by hold-down cable assemblies that loop over the tubular mount with each hold-down cable's downward-reaching cable eyes retained by washers at opposite ends of a cable anchor bolt. Cable anchor bolts are oriented parallel to the axis of the above tubular mount, with each cable anchor bolt extending through a vertical slot in its associated mounting strut. Mounted in this fashion, each cable anchor bolt is thereby constrained to upward movement that loosens the hold-down cable, or downward movement that tightens the hold-down cable. A set screw internal to each mounting strut bears downward on the shaft of the mounting strut's cable anchor bolt, so as to forcibly tighten the hold-down cable. Each set screw extends upward through a hole in the lower wall of the tubular mount, and sufficient space is accessible inside the tubular mount to allow the set screw to be adjusted.

Structural rigidity and strength provided by the wing mounting gear are sufficient to allow an aft extension tube to be attached to the wing, projecting rearward in cantilever fashion. For increased security when trapezing, the aft extension tube incorporates adhesively-attached traction strips similar to those applied to diving boards or swimming pool ladders.

The main extension tube and aft extension tube are in longitudinal alignment and mutually enclose a tubular storage tray that is removable by way of an elevated support rail access cover. In the embodiments described herein this elevated support rail access cover is located at the aft end of the elevated support rail. Other embodiments are certainly possible however, with an access cover located at the forward end of the elevated support rail. The storage tray incorporates finger holes that provide a grip as the tray is drawn aft to its extended position. A longitudinal slot provides above access along the length of storage tray and allows items such as blankets and towels to be compressed by a small amount during re-insertion of the storage tray into the elevated support rail.

The present invention also provides an insulated tubular container or cooler tube that runs atop and slightly inboard of the catamaran's existing trampoline support rail. The cooler tube is tensioned between the forward and aft wing mounting gear and is sealed at its aft end by an attached end cap. At its forward end, the cooler tube incorporates a removable access cover. The cooler tube access cover is linked by a retrieve strap to a pull cylinder that is free to travel the internal length of the cooler tube.

Along its inboard edge, a rectangular fabric trap seat is doubled upon itself and sewn so as to form a sheath that wraps around the cooler tube. Foam padding between the trap seat fabric and cooler tube serves the combined purpose of insulation and improved seating comfort. Along its outboard edge, the trap seat wraps over the main extension tube and is removably attached by means of snap fittings.

Each wing also provides an outboard-mounted cooler for food and picnic supplies. Integral attachment of the outboard coolers is accomplished by mounting straps that wrap over the main extension tube and attach using snap fittings in similar fashion to the trap seat. Cooler mounting straps are permanently attached to the coolers by means of strap attachment bolts and attachment bolt washers.

The single tiller extension pole normally attached at the center of the existing catamaran's tiller crossbar is replaced with two tiller extension poles attached at locations symmetrically spaced about the midpoint of the tiller crossbar. The outboard-reaching end of each tiller extension pole is supported by the extension wing on the same side, and normally rides in a tiller extension pole guide that is solidly mounted to the extension wing's elevated support rail. The tiller extension pole guide has a locking feature that allows the helmsman to unhand the tiller extension pole during a tack, while the rudders remain fixed at a pre-selected angle. The helmsman can then remain outboard at his original location as long as possible during the tack, without having to move to center of the boat in order to swivel the tiller extension pole to the other side. This delay by the helmsman in moving from his original outboard position is advantageous during the initial portion of the tack because it assists the turning process by applying more weight and drag to the hull on the original windward side, allowing the opposite side hull to ride higher and encounter less drag as it travels the additional distance necessary to come across the eye of the wind. Without the necessity of swiveling the tiller extension pole, the helmsman is also free to continue facing forward so as to monitor the progress of the tack. If the tack is not progressing well, the helmsman can then make an earlier decision to either abort the tack, or try to manipulate the sails in order to make the tack succeed. When the centerline of the boat has passed through the eye of the wind and the optimum time to change sides has arrived, the helmsman can quickly cross to the other side of the boat without facing aft and pausing to manipulate the filler extension pole. Once on the other side, the helmsman can free the rudders by pulling on the opposite side tiller extension pole. The position of the rudders during the tack is set by means of a sliding knob on the tiller extension pole and can easily be reset, if desired, prior to the next tack. The extension wing integrally supports the use of the dual tiller assembly since it serves to elevate the downwind tiller extension pole so that it does not normally contact the water when the catamaran is being sailed at its optimum heeling angle.

Two embodiments of the present invention share the above described characteristics, and differ substantially only in their methods of stowage and deployment. Embodiment 1 discloses an extension wing designed for fold-in and fold-out deployment. Embodiment 2 discloses an extension wing designed for slide-in and slide-out deployment. Embodiment 1 is particularly suited to frequent trailering and provides reduced set-up time. Embodiment 2 involves a small amount of additional set-up time when trailering, but provides increased storage space within the forward and aft support arms.

Significant differences between embodiments 1 and 2 include the use of a swept wing configuration and a shorter seat and cooler tube by the embodiment 1 design. Design permutations of either embodiment with respect to these features are possible. Embodiment 1 for example, could include a longer cooler tube with a non-rectangular trap seat shaped to fill the area behind the wings forward support arm.

Here-described embodiments of the present invention employ 4" plastic polyvinyl chloride (PVC) piping and tubular fittings for the outboard wing elements, and 3" PVC piping and tubular fittings for the inboard cooler tubes. Tailored to reduce material costs, these embodiments do not require special moldings or extrusions, although they do require occasional non-standard attachment methods and machining of certain PVC parts.

Although detailed specifically with respect to the Hobie 16 Catamaran, concepts characteristic of the present invention may also be applicable to other small catamarans. These concepts may also manifest themselves in the form of lighter, more aesthetic embodiments that employ specially molded parts. The same concepts may further apply with respect to use of non-PVC tube, or for that matter to the use of differently sized tube with different cross-sectional shaping, such as elliptical, for example.

Further complimentary interactions and advantages associated with various elements of the present invention will become apparent from a consideration of the ensuing detailed description and drawings.

DRAWINGS FIGURES

The accompanying drawings illustrate in detail the preferred embodiments of this invention. For each embodiment, only the port wing is shown. The starboard wing uses identical components, and is essentially a mirror image of the port wing. Figures are enumerated using the numeral 1 for the first embodiment, the numeral 2 for the second embodiment, and the numeral 3 for components common to both embodiments. Alphabetic suffixes are attached to the figure numbers in order to identify related drawings.

REFERENCE NUMERALS IN DRAWINGS

Figure 1A:
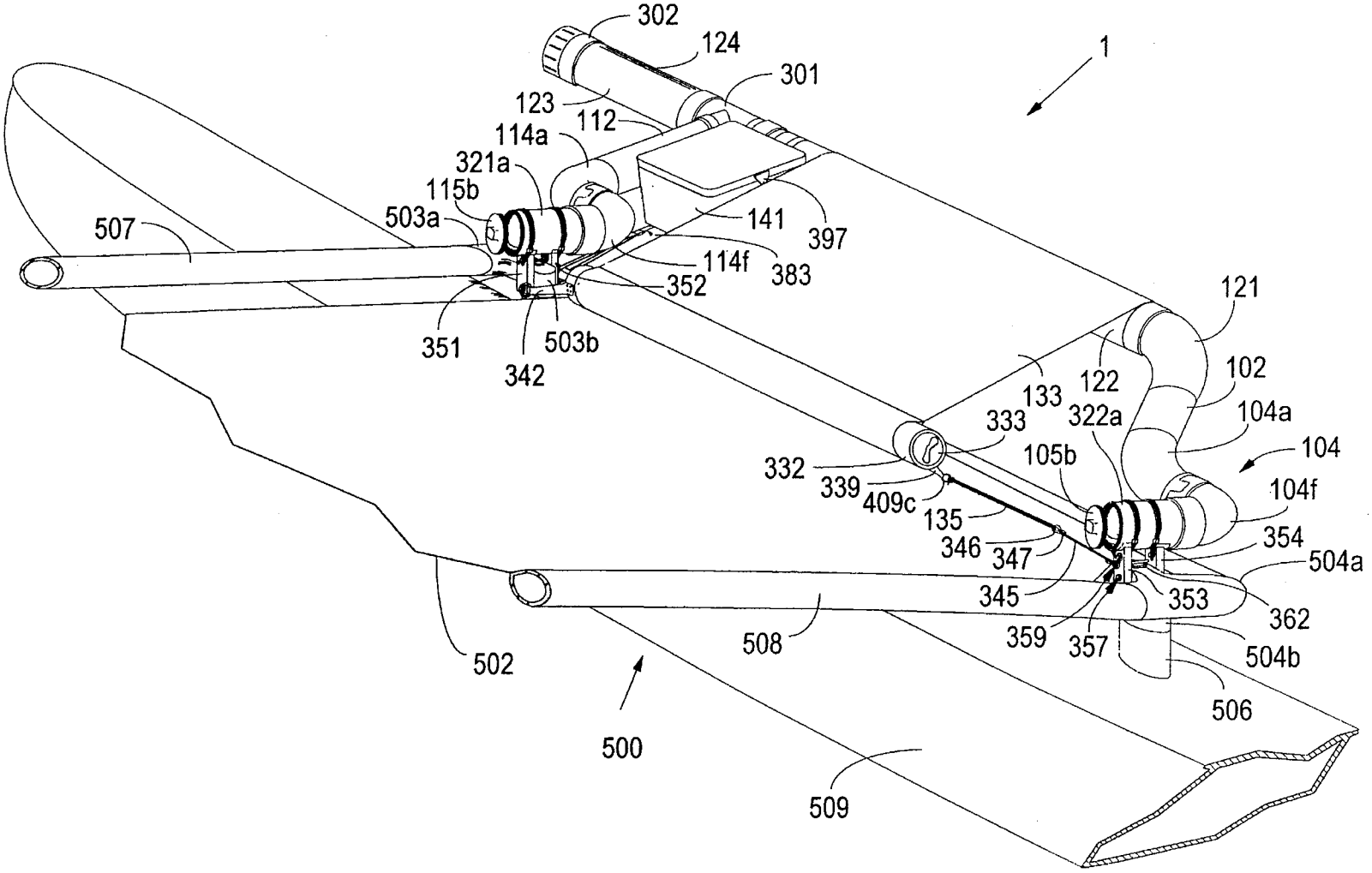
FIG. 1A is a perspective view of embodiment 1, shown in its folded-out or deployed position.

Parts sufficient to construct both embodiments of this invention are identified in the following list.

Part Numbering Conventions:

Parts specific to Embodiment 1 are numbered from 100 to 199.

Parts specific to Embodiment 2 are numbered from 200 to 299.

Parts common to both Embodiments are numbered from 300 to 499.

Existing catamaran parts are numbered from 500 to 599.

| Item # | Description | Qty |
|---|---|---|
| 1 | Volumetric Extension Wing With Fold-Out Deployment (Embodiment 1) | — |
| 2 | Volumetric Extension Wing With Slide-Out Deployment (Embodiment 2) | — |
| 100–199; | Items Particular to Embodiment 1 | — |
| 100 | Forward Support Arm Assembly Elements, Embodiment 1 Particular | — |
| 101 | Upper Internal Attach Tube Assembly | — |
| 101a | Upper Attach Tube | 1 |
| 101b | Middle Upper Attach Tube | 1 |
| 101c | Upper Through-Tube | 1 |
| 102 | Forward Arm Tube | 1 |
| 103 | Lower Internal Attach Tube Assembly | — |
| 103a | Middle Lower Attach Tube | 1 |
| 103b | Lower Attach Tube | 1 |
| 103c | Lower Through-Tube | 1 |
| 104 | Forward Swivel-Lock Assembly | — |
| 104a | Outboard 45° Male/Female Tubular Fitting | 1 |
| 104b | Outboard Liner Ring | 1 |
| 104c | Outboard Inner Liner Ring | 1 |
| 104d | Swivel-Lock Through-Tube | 1 |
| 104e | Inner End Cap | 1 |
| 104f | Inboard 90° Female/Female Tubular Fitting | 1 |
| 104g | Inboard Liner Ring | 1 |
| 104h | Inboard Inner Liner Ring | 1 |
| 105i | Wing Locking Cap | 1 |
| 104ia | Inner Ring Nut | 1 |
| 104ib | Inner Ring Nut Plug | 1 |
| 105 | Forward Tubular Mount Closure Assembly | — |
| 105a | Tubular Mount End Coupling | 1 |
| 105b | Tubular Mount Access Cap | 1 |
| 105c | Access Cap Screw Pad | 1 |
| 105d | Retainer Strap | 1 |
| 110 | Aft Support Arm Assembly Elements, Embodiment 1 Particular | — |
| 112 | Aft Arm Tube | 1 |
| 113 | Internal Attach Tube Assembly | — |
| 113a | Upper Attach Tube | 1 |
| 113b | Lower Attach Tube | 1 |
| 113c | Through-Tube | 1 |
| 114 | Aft Swivel-Lock Assembly | — |
| 114a | Outboard Swivel-Lock 90° Male/Female Tubular Fitting | 1 |
| 114b | Outboard Liner Ring | 1 |
| 114c | Outboard Inner Liner Ring | 1 |
| 114d | Swivel-Lock Through-Tube | 1 |
| 114e | Inner End Cap | 1 |
| 114f | Inboard Swivel-Lock 90° Female/Female Tubular Fitting | 1 |
| 114g | Inboard Swivel-Lock Liner Ring | 1 |
| 114h | Inboard Sivel-Lock Inner Liner Ring | 1 |
| 114i | Wing Locking Cap | 1 |
| 114ia | Inner Ring Nut | 1 |
| 114ib | Inner Ring Nut Plug | 1 |
| 115 | Aft Tubular Mount Closure Assembly | — |
| 115a | Tubular Mount End Coupling | 1 |
| 115b | Tubular Mount Access Cap | 1 |
| 115c | Access Cap Screw Pad | 1 |
| 115d | Retainer Strap | 1 |
| 120 | Elevated Support Rail Elements, Embodiment 1 Particular | — |
| 121 | Forward Corner 45° Male/Female Tubular Fitting | 1 |
| 122 | Main Extension Tube | 1 |
| 123 | Aft Extension Tube | 1 |
| 124 | Aft Traction Strip | 1 |
| 130 | Trap Seat Assembly Elements, Embodiment 1 Particular | — |
| 131 | Cooler Tube | 1 |
| 132 | Insulating Padding | 1 |
| 133 | Trap Seat | 1 |
| 134 | Outboard Foam Padding | 1 |
| 135 | Forward Tension Rope | 1 |
| 140 | Outboard Cooler Assembly Elements, Embodiment 1 Particular | — |
| 141 | Cooler w/Holes Drilled For Transverse Mounting | 1 |
| 142 | Cooler Outer Suspension Straps | 2 |
| 143 | Cooler Center Suspension Strap | 1 |

-continued

| Item # | Description | | Qty |
|---|---|---|---|
| 200–299; | Items Particular to Embodiment 2 | | — |
| 200 | Forward Support Arm Assembly Elements, Embodiment 2 Particular | | — |
| 201 | Outboard Joiner Tube | | 1 |
| 202 | Outboard 45° Female/Female Tubular Fitting | | 1 |
| 203 | Inboard Joiner Tube | | |
| 204 | Inboard 45° Male/Female Tubular Fitting | | 1 |
| 205 | Re-enforcement Band | | 1 |
| 206 | Inner Mounting Tube Sleeve | | 1 |
| 207 | Inner Mounting Tube | | 1 |
| 208 | Inner Mounting Tube Ring Nut | | 1 |
| 209 | Exapnding Plug | | 1 |
| 211 | Expanding Plug Strap | | 1 |
| 212 | Plug Strap Attach Ring | | 1 |
| 213 | Plug Strap Male/Female Snap Fitting Pair | | 1 |
| 220 | Aft Support Arm Assembly Elements, Embodiment 2 Particular | | — |
| 221 | Outboard Joiner Tube | | 1 |
| 222 | Outboard 45° Female/Female Tubular Fitting | | 1 |
| 223 | Inboard Joiner Tube | | 1 |
| 224 | Inboard 45° Male/Female Tubular Fitting | | 1 |
| 225 | Re-enforcement Band | | 1 |
| 226 | Inner Mounting Tube Sleeve | | 1 |
| 227 | Inner Mounting Tube | | 1 |
| 228 | Inner Mounting Tube Ring Nut | | 1 |
| 229 | Expanding Plug | | 1 |
| 231 | Expanding Plug Strap | | 1 |
| 232 | Plug Strap Attach Ring | | 1 |
| 233 | Plug Strap Male/Female Snap Fitting Pair | | 1 |
| 240 | Elevated Support Rail Assembly Elements, Embodiment 2 Particular | | — |
| 241 | Forward Corner 90° Female/Female Tubular Fitting | | 1 |
| 242 | Main Extension Tube | | 1 |
| 243 | Aft Extension Tube | | 1 |
| 244 | Aft Traction Strip | | 1 |
| 250 | Trap Seat Assembly Elements, Embodiment 2 Particular | | — |
| 251 | Cooler Tube | | 1 |
| 252 | Insulating Padding | | 1 |
| 253 | Trap Seat | | 1 |
| 254 | Outboard Foam Padding | | 1 |
| 255 | Forward Tension Rope | | 1 |
| 260 | Outboard Cooler Assembly Elements, Embodiment 2 Particular | | — |
| 261 | Cooler w/Holes Drilled For Longitudinal Mounting | | 1 |
| 262 | Cooler Outer Suspension Straps | | 2 |
| 263 | Cooler Center Suspension Strap | | 1 |
| 300–399; | Items Common to Embodiments 1 and 2 | | — |
| 300 | Elevated Support Rail Assembly Elements, Embodiments 1 & 2 Common | | — |
| 301 | Tubular T-Fitting | | 1 |
| 302 | Aft End Coupling | | 1 |
| 303 | Elevated Support Rail Access Cover | | 1 |
| 304 | Access Cover Retainer Strap | | 1 |
| 305 | Retainer Strap Screw Pad | | 1 |
| 308 | Screw-Mounted Male Snap Fitting | | 13 |
| 309 | Storage Tray | | 1 |
| 311 | Strage Tray Finger Holds | | 2 |
| 320 | Support Arm Mount Assemblies, Embodiments 1 & 2 Common | | — |
| 321 | Aft Support Arm Mount | | 1 |
| 321a | tubular mount | | 1 |
| 321b | Tubular Mount Outboard Inner Liner | | 1 |
| 321c | Tubular Mount Inboard Inner Liner | | 1 |
| 321d | Tubular Mount Bushing Plates | | 2 |
| 321e | Tubular Mount Bushing Attach Screws | | 8 |
| 322 | Forward Support Arm Mount | | 1 |
| 322a–322e: | Identical to 321a–321e Above | | — |
| 330 | Trap Seat Assembly Elements, Embodiments 1 & 2 Common | | — |
| 331 | Aft End Cap | | 1 |
| 332 | Forward End Coupling | | 1 |
| 333 | Cooler Tube Access Cover | | 1 |
| 334 | Access Cover Strap Screw Pad | | 1 |
| 335 | Retrieve Strap | | 1 |
| 336 | Pull Cylinder Strap Screw Pad | | 1 |
| 337 | Pull Cylinder | | |
| 338 | Reinforcement Strap | | 1 |
| 339 | Forward Cooler Tube Strap | | 1 |
| 341 | Aft-Outboard Cooler Tube Strap | | 1 |
| 342 | Aft-Inboard Cooler Tube Strap | | 1 |
| 343 | Support Straps | Embodiment 1 Qty - | 10 |
| | | Embodiment 2 Qty - | 9 |
| 344 | Female Snap Fittings | Embodiment 1 Qty - | 10 |

-continued

| Item # | Description | | Qty |
|---|---|---|---|
| | | Embodiment 2 Qty - | 9 |
| 345 | Forward Tension Cable | | 1 |
| 346 | Cable Eye Sleeve | | 1 |
| 347 | Oval Compression Sleeves | | 2 |
| 350 | Wing Mounting Gear | | — |
| 351 | Aft-Inboard Mounting Strut | | 1 |
| 352 | Aft-Outboard Mounting Strut | | 1 |
| 353 | Forward-Inboard Mounting Strut | | 1 |
| 354 | Forward-Outboard Mounting Strut | | 1 |
| 355 | Mounting Strut Set Screws | | — |
| 355a | Aft-Inboard Mounting Strut Set Screw | | 1 |
| 355b | Aft-Outboard Mounting Strut Set Screw | | 1 |
| 355c | Fwd-Inboard Mounting Strut Set Screw | | 1 |
| 355d | Fwd-Outboard Mounting Strut Set Screw | | 1 |
| 356 | Aft Lower Through Bolt Assembly | | 1 |
| 356a | Aft Lower Through Bolt | | 1 |
| 356b | Aft Lower Through Bolt Strap Anchor Washers | | 4 |
| 356c | Aft Lower Through Bolt Inboard Spacer Nut | | 1 |
| 356d | Aft Lower Through Bolt Outboard Spacer Nut | | 1 |
| 356e | Aft Lower Through Bolt Locking Nut | | 1 |
| 357 | Forward Lower Through Bolt Assembly | | 1 |
| 357a | Forward Lower Through Bolt | | 1 |
| 357b | Forward Lower Through Bolt Washer | | 1 |
| 357c | Forward Lower Through Bolt Locking Nut | | 1 |
| 358 | Aft Upper Through Bolt Assembly | | 1 |
| 358a | Aft Upper Through Bolt | | 1 |
| 358b | Aft Upper Through Bolt Washer | | 1 |
| 358c | Aft Upper Through Bolt Locking Nut | | |
| 359 | Forward Upper Through Bolt Assembly | | 1 |
| 359a | Forward Upper Through Bolt | | 1 |
| 359b | Forward Upper Through Bolt Cable Anchor Washers | | 2 |
| 359c | Forward Upper Through Bolt Spacer Nut | | 1 |
| 359d | Forward Upper Through Bolt Locking Nut | | 1 |
| 361 | Aft Support Bushing | | 1 |
| 362 | Forward Support Bushing | | 1 |
| 371 | FOrward-Inboard Hold-Down Cable Assembly | | — |
| 371a | Cable Loop | | 1 |
| 371b | Cable Swage Sleeves | | 2 |
| 371c | Cable Anchor Bolt | | 1 |
| 371d | Cable Anchor Bolt Sleeves | | 2 |
| 371e | Cable Anchor Bolt Washers | | 6 |
| 371f | Cable Anchor Bolt Locking Nut | | 1 |
| 372 | Forward-Outboard Hold-Down Cable Assembly | | — |
| 372a–372f: | Identical to 371a through 371f above | | — |
| 373 | Aft-Inboard Hold-Down Cable Assembly | | — |
| 373a–373f: | Identical to 371a through 371f above | | — |
| 374 | Aft-Outboard Hold-Down Cable Assembly | | — |
| 374a–374f: | Identical to 371a through 371f above | | — |
| 380 | Outboard Cooler Elements, Embodiments 1 & 2 Common | | — |
| 381 | Cooler Lid Seal | | 1 |
| 382 | Female Snap Fittings | | 3 |
| 383 | Mounting Strap Buckles | | 3 |
| 384 | Aft-Underside-Inboard Strap Attach Bolt Assembly | | 1 |
| 384a | Attach Bolt | | 1 |
| 384b | Washers | | 1 |
| 384c | Locking Nut | | 1 |
| Note: | Items 385 through 396 below are identical in composition to Item 384a detailed above. | | |
| 385 | Aft-Underside-Outboard Strap Attach Bolt Assembly | | 1 |
| 386 | Aft-Outside-Lower Strap Attach Bolt Assembly | | 1 |
| 387 | Aft-Outside-Upper Strap Attach Bolt Assembly | | 1 |
| 388 | Center-Underside-Inboard Strap Attach Bolt Assembly | | 1 |
| 389 | Center-Underside-Outboard Strap Attach Bolt Assembly | | 1 |
| 391 | Center-Outside-Lower Strap Attach Bolt Assembly | | 1 |
| 392 | Center-Outside-Upper Strap Attach Bolt Assembly | | 1 |
| 393 | Forward-Underside-Inboard Strap Attach Bolt Assembly | | 1 |
| 394 | Forward-Underside-Outboard Strap Attach Bolt Assembly | | 1 |
| 395 | Forward-Outside-Lower Strap Attach Bolt Assembly | | 1 |
| 396 | Forward-Outside-Upper Strap Attach Bolt Assembly | | 1 |
| 397 | Outboard Cooler Lid Latch | | 1 |
| 400 | Retainer Strap Elements, Embodiments 1 & 2 Common | | — |
| 401 | Access Cover Retainer Strap Screws | Embodiment 1 Qty - | 8 |
| | | Embodiment 1 Qty - | 10 |
| 402 | Access Cover Retainer Strap Washers | Embodiment 1 Qty - | 8 |
| | | Embodiment 1 Qty - | 10 |
| 403 | Retainer Strap Screws | | 12 |
| 404 | Retainer Strap Washers | | 12 |
| 405 | Strap Attach Rings | | 3 |

-continued

| Item # | Description | Qty |
|---|---|---|
| 405a | Cooler Tube Aft-Inboard Strap Attach Ring | 1 |
| 405b | Cooler Tube-Aft-Outboard Strap Attach Ring | 1 |
| 405c | Cooler Tube Forward Strap Attach Ring | 1 |
| 410 | Dual Tiller Extension Pole Rudder Control Assem. (One Side Only) | 1 |
| 411 | Tiller Extension Pole Guide Assembly | 1 |
| 411a | Extension Pole Guide Retainer Hook | 1 |
| 411b | Extension Pole Detent | 1 |
| 411c | Extension Pole Guide Base | 1 |
| 420 | Tiller Extension Pole Assembly | 1 |
| 421 | Adjustable Catch Assembly | 1 |
| 421a | Slider Tube | 1 |
| 421b | Catch Hook | 1 |
| 421c | Leaf Spring | 1 |
| 421d | Outboard Leaf Spring Retainer Plug | 1 |
| 421e | Inboard Leaf Spring Retainer Plug | 1 |
| 421f | Catch Hook Nub Hole | 1 |
| 421g | Catch Position Adjust Holes | 1 |
| 421h | Catch Position Adjust Slot | 1 |
| 422 | Tiller Extension Pole Shaft | 1 |
| 423 | Tiller Extension Pole Pivotable Attachment Joint | 1 |
| 500 | Existing Catamaran Hull and Superstructure (One Side Only) | — |
| 501 | Trampoline Support Rail | 1 |
| 502 | Trampoline | 1 |
| 503 | Aft Corner Casting | 1 |
| 503a | Aft Mounting Elbow | 1 |
| 503b | Aft Pylon Cap | 1 |
| 504 | Forward Corner Casting | 1 |
| 504a | Forward Mounting Elbow | 1 |
| 504b | Forward Pylon Cap | 1 |
| 505 | Aft Corner Pylon | 1 |
| 506 | Forward Corner Pylon | 1 |
| 407 | Aft Cross Beam | 1 |
| 508 | Forward Cross Beam | 1 |
| 509 | Hull | 1 |
| 511 | Tiller Crossbar | 1 |
| 512 | Tiller (1 of 2) | 1 |
| 513 | Motor and Motor Mount Assembly (Optional) | 1 |
| 513a | Motor Mount Base | 1 |
| 513b | Motor Mount Pivot Joint | 1 |
| 513c | Motor Mount Arm | 1 |
| 513d | Motor | 1 |

Note:
1. Quantities shown for one wing only, quantities for opposite wing are identical.

DESCRIPTION—FIGS. 1A–3F

Port and starboard sides of the existing catamaran are essentially mirror images of each other, as are the opposite side extension wings mounted to the catamaran superstructure. Detailed descriptions of extension wing elements of one side are therefore applicable to corresponding opposite side elements.

Figure 2A:
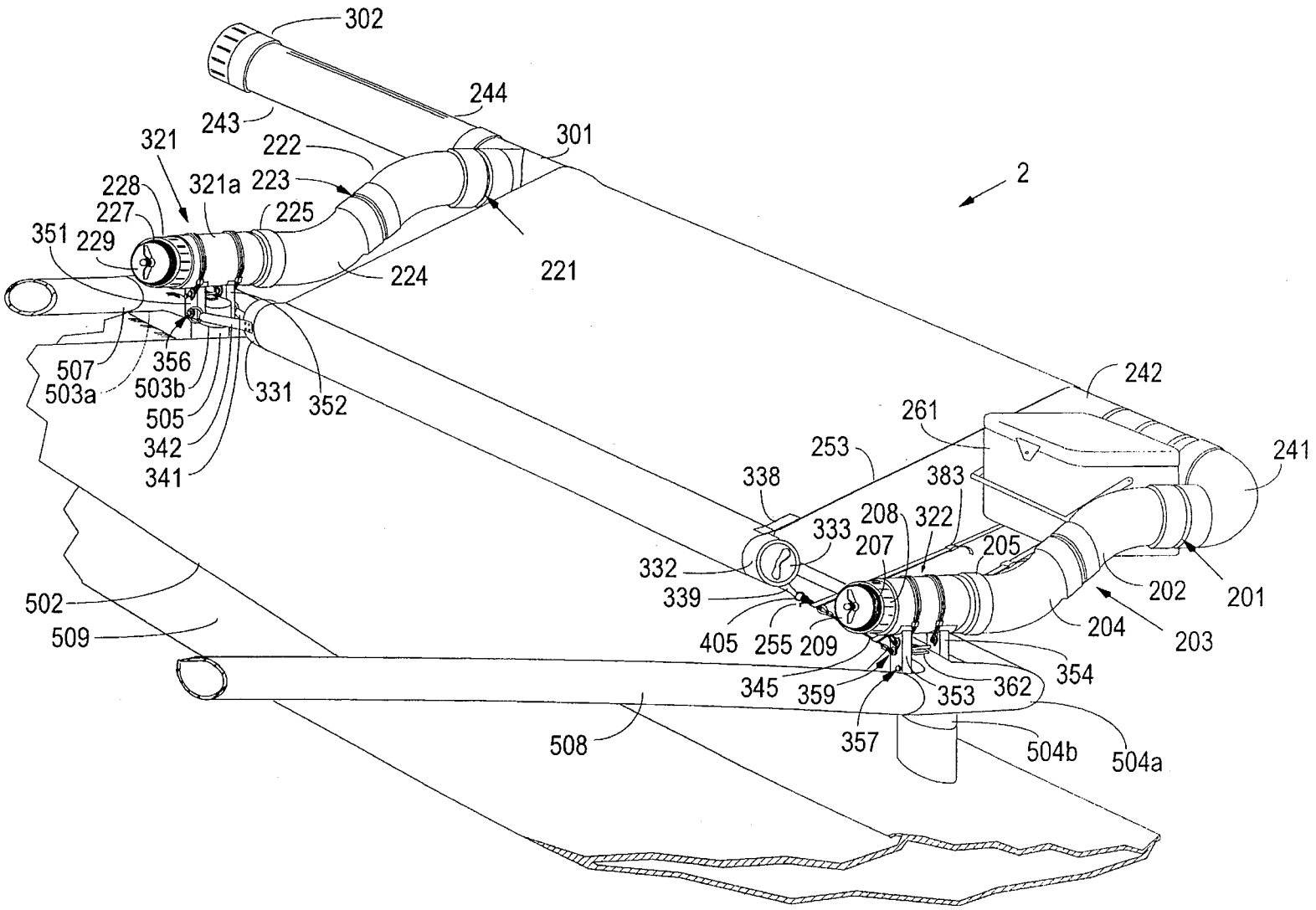
FIG. 2A is a perspective view of embodiment 2, slide-mounted into its deployed position.
Figure 3A:
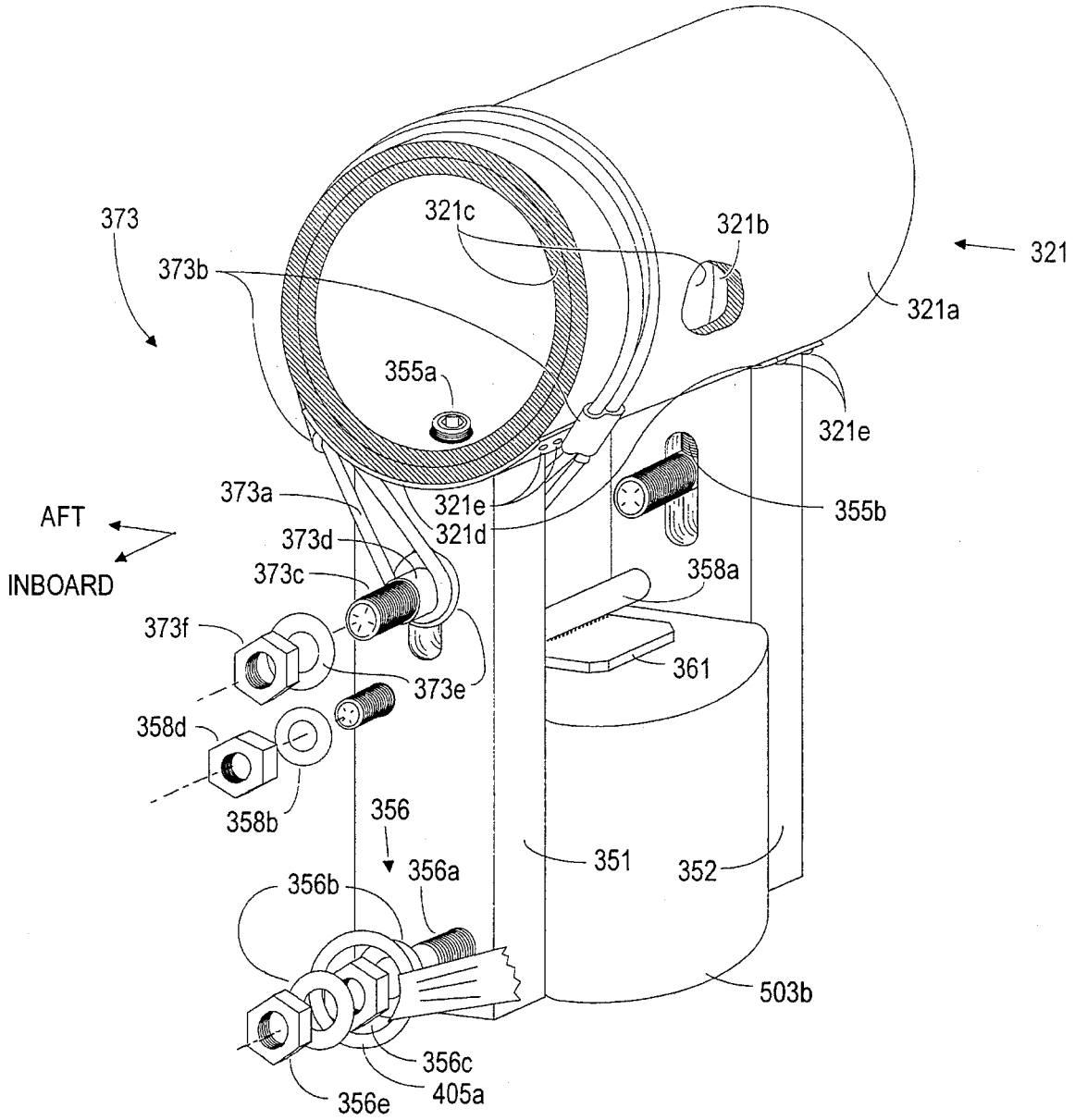
FIG. 3A is a perspective close-up of the mounting assembly design employed by both embodiments 1 and 2 for secure attachment to the existing sailboat superstructure.
Figure 3B:
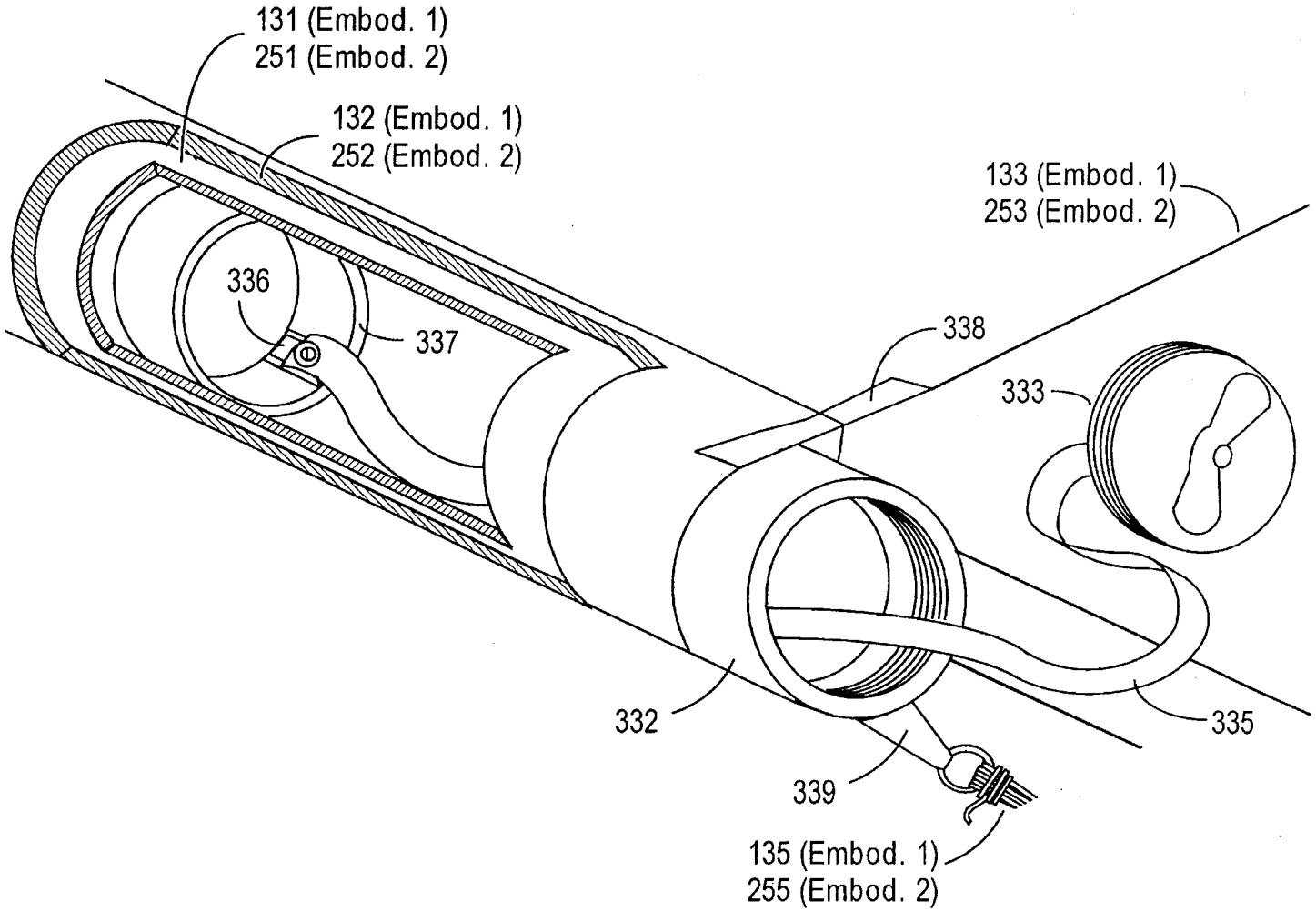
FIG. 3B is a perspective view of the trap seat cooler design employed by both embodiments 1 and 2.

FIG. 1A shows one side of an existing catamaran sailboat hull and superstructure 500 with a volumetric catamaran sailboat extension wing embodiment 1 attached. FIG. 2A shows the same catamaran parts with volumetric catamaran sailboat extension wing embodiment 2 attached. Key elements of the catamaran include a hull 509, and projecting vertically from the hull, an aft corner pylon 505, and a forward corner pylon 506. Mounted atop the aft corner pylon is an aft corner casting 503. The aft corner casting is a one-piece unit consisting of an aft pylon cap 503*b* portion that mounts atop the aft corner pylon, and an aft mounting elbow 503*a* portion. The aft corner casting 503 forms one corner of a general rectangular superstructure that provides a support frame for a trampoline 502. A forward corner casting 504, forms the forward comer of the rectangular superstructure on the same side as aft corner casting 503. Forward corner casting 504 is also a one-piece unit with a forward nylon cap 504*b* portion, and a forward mounting elbow 504*a* portion. Attached to, and extending between the forward and aft corner castings is a trampoline support rail 501 that also serves as a foot rail during trapezing. An aft cross beam 507 attaches to, and extends transversely inboard from the aft corner casting 503, attaching to an opposite side aft corner casting (not shown). In like fashion, a forward cross beam 508, attaches to, and extends transversely inboard from the forward corner casting 504, attaching to the opposite side forward corner casting (not shown). FIG. 3F shows other elements of the existing catamaran that interact with a dual tiller extension pole arrangement incorporated by both embodiments of the present invention. Among these are the port tiller 512 and its starboard counterpart 512'. Both tillers attach to opposite ends of a tiller crossbar 511 and as a result, any movement of one tiller will result in a corresponding equal movement of the opposite side filler. Commonly installed optional gear includes a motor mount assembly 513. Components of this motor mount assembly include a motor mount base 513a attached at the midpoint of the catamaran's aft cross beam 507, a pivot joint 513*b* joined to motor mount base 513*a* and providing an axis of rotation for motor mount arm 513*c*, which in turn supports motor 513*d*.

Wing mounting gear attaching the aft end of volumetric extension wing 1 or 2 to the existing catamaran includes an aft-inboard mounting strut 351 and an aft-outboard mounting strut 352 that sandwich or bracket the existing catamaran aft pylon cap 503*b*. FIG. 3A shows aft wing mounting gear details typical of both embodiments 1 and 2. As shown in FIG. 3A, an aft lower through bolt assembly 356 provides the primary means of attachment, using an existing bolt hole in the aft pylon cap 503*b* and aft corner pylon 505. An aft upper through bolt assembly 358 also extends through the aft mounting struts 351,352, but passes over the aft pylon cap 503*b* without penetrating it. Upper through bolt assembly 358 and lower through bolt assembly 356 are not vertically aligned but penetrate the mounting strut trailing and leading edges respectively. An aft support bushing 361 is inserted between the bolt shaft of the upper through bolt assembly 358 and the upper surface of aft pylon cap 503*b*.

A forward end wing mounting gear assembly employed by volumetric extension wing embodiments 1 and 2 is physically similar to the above described aft end wing mounting gear. FIG. 1A shows a forward-inboard mounting strut 353 and a forward-outboard mounting strut 354 that attach to the existing catamaran forward pylon cap 504*b* by means of a forward upper through bolt assembly 359 and a forward lower through bolt assembly 357. Like their aft counterparts, the forward upper and lower through bolt assemblies are staggered, with upper through bolt assembly 359 penetrating the trailing edges of the mounting struts, and lower through bolt assembly 357 penetrating the leading edges of the mounting struts. A forward support bushing 362 is inserted between the forward pylon cap 504*b* and the upper through bolt assembly 359.

The forward and aft wing mounting gear attach to tubular wing frame members in a fashion that is common to both volumetric extension wing embodiments 1 and 2. As shown by FIG. 3A, both the forward pair 353,354 and aft pair 351,352 of mounting struts incorporate concave surfaces at their upward-facing ends so as to support a forward support arm mount 322 and an aft support arm mount 321, respectively.

The aft wing mounting gear also includes an aft-inboard hold-down cable assembly 373, and an aft-outboard hold-down cable assembly 374, each wrapping over the aft support arm mount 321. Likewise, and as shown by FIG. 1A, the forward wing mounting gear includes a forward-inboard hold-down cable assembly 371, and a forward-outboard hold-down cable assembly 372, each wrapping over the forward support arm mount 322.

The aft support arm mount 321 consists of an aft tubular mount 321*a*, reinforced by two inner liners; a tubular mount outboard inner liner 321*b*, and a tubular mount inboard inner liner 321*c*. The interface between aft mounting struts 351, 352 and aft support arm mount 321 is typical and is shown in detail by FIG. 3A. In the areas supported by the mounting struts, a set of curved tubular mount bushing plates 321*d* is installed, with each bushing plate secured by attach screws 321*e*, or by a suitable adhesive. The forward support arm mount 322 is of identical construction to the aft support arm mount 321, consisting of elements 322*a* through 322*e* that are physically and functionally identical to the respective above noted elements 321*a* through 321*e*.

Aft-inboard hold-down cable assembly 373 is typical of the hold-down cable assemblies employed by the wing mounting gear for the purpose of securing the aft and forward support arm mounts. As shown in FIG. 3A, the aft-inboard hold-down cable assembly includes a cable loop 373*a*, a pair of oval swage sleeves 373*b*, a cable anchor bolt 373*c*, a pair of cable anchor bolt sleeves 373*d*, a set of cable anchor bolt washers 373*e*, and a cable anchor bolt locking nut 373*f*. Cable loop 373*a* was originally formed as a simple circular cable loop with overlapping ends secured together by oval swage sleeves 373*b* so as to form a double section of cable between the sleeves 373*b* accounting for approximately one third of the cable loop, with the balance of the cable loop consisting of a single section of cable. By selecting points on the single section of cable that are equidistant from the cable swages and 180° opposite on the cable loop, and by drawing those points apart, the single and double sections of cable are straightened and drawn together to the extent that they are substantially parallel. Formed in this fashion, the cable loop 373*a* then wraps over the aft support arm mount 321 so that the single section of cable is sandwiched between both cables of the double section, and so that downward-reaching cable eyes are retained by washers 373*e* at opposite ends of the cable anchor bolt 373*c*. Cable anchor bolt 373*c*, extends through a vertical slot in the aft mounting strut 351 and is positioned directly below and aligned parallel to the axis of the aft support arm mount 321. An aft-inboard mounting strut set screw 355*a* is vertically oriented so as to bear down upon the shaft of cable anchor bolt 373*c*. Set screw 355*a* extends upward through a hole in the lower wall of the tubular mount, and sufficient space is accessible inside the tubular mount to allow the set screw to be adjusted. When fully tightened, the upper end of the set screw is flush with, or recessed slightly below the inside wall of the aft support arm mount 321. Hold-down cable assemblies 371 and 372 of the forward wing mounting gear, and the outboard-hold-down cable assembly 374 of the aft wing mounting gear are physically and functionally identical to the aft-inboard hold-down cable assembly 373, each therefore including a cable anchor bolt whose shaft is borne down upon by a set screw, as shown by FIG. 3A for the case of cable anchor bolt 373*c*, and set screw 355*a*. Both embodiments of the present invention also incorporate an insulated tubular container or cooler tube that runs atop and slightly inboard of the sailboat's existing trampoline support rail 501, and is tensioned between the forward pylon cap 504*b* and aft pylon cap 503*b*. The cooler tube design incorporated in embodiment 1 and shown by FIG. 1A is essentially equivalent to the cooler tube design incorporated in embodiment 2 and shown by FIG. 2A, except that the cooler tube of embodiment 2 is longer. FIG. 3B shows a detailed view of the embodiment 2 cooler tube, and also illustrates details common to the embodiment 1 cooler tube design. As shown by FIG. 3B an embodiment 2 cooler tube 251 (or 131 for embodiment 1) is wrapped by a layer of insulating padding 252 (or 132 for embodiment 1). An embodiment 2 trap seat 253 (or 133 for embodiment 1) is sewn along its inboard edge so as to form a sleeve that wraps around the cooler tube insulating padding. A reinforcement strap 338 prevents eventual ripping along the seam of the cooler tube sleeve, near the trap seat's forward-inboard comer. At its forward end, the cooler tube is capped by a forward end coupling 332 that is threaded to accept a screw-on cooler tube access cover 333. A small block of material or cover strap screw pad 334 (not shown) is adhesively attached to access cover 333 so as to provide a base that permits a retrieve strap 335 to be attached to the access cover using a retainer strap screw and washer. In similar fashion, the other end of retainer strap 335 is attached to a pull cylinder strap screw pad 336 and pull cylinder 337 located inside the cooler tube. The pull cylinder is free to travel from the forward end to the aft end the cooler tube, at which point it is blocked by an adhesively attached aft end cap 331, as shown by FIG. 1A.

The method employed to secure the aft end of the cooler tube is shared by both embodiments 1 and 2, and may be explained by reference to either FIG. 1A or FIG. 2A. As shown by FIG. 1A for example, end cap 331 is secured to both ends of the aft lower through bolt assembly 356 by an aft-outboard cooler tube strap 341, and an aft-inboard cooler tube strap 342. FIG. 3A details the attachment of the aft-inboard cooler tube strap 342 to the inboard end of the aft lower through bolt assembly 356. As shown in this figure, strap 342 is sewn to a cooler tube aft-inboard strap attach ring 405*a* that encircles a spacer nut 356*c*. Spacer nut 356*c* is sandwiched between a pair of strap anchor washers 356*b*, with the outer washer retained by a locking nut 356*e*. At the outboard end of the lower through bolt assembly 356, an outboard cooler tube strap 341 is secured in the same fashion as the inboard cooler tube strap 342, except that the spacer nut, attach ring and strap anchor washers are secured under the bolt head of the lower through bolt assembly 356.

Attachment of the forward cooler tube end to the sailboat is shown by FIG. 2A for embodiment 2, or by FIG. 1A for embodiment 1. As shown in these figures, the forward end of the cooler tube is secured by a cooler tube forward strap 339 that is sewn to a cooler tube strap attach ring 405*c*. Attach ring 405*c* then connects to a forward tension cable 345 by means of a forward tension rope 255 in the case of embodiment 2, or a forward tension rope 135 in the case of embodiment 1.

Figure 1B:
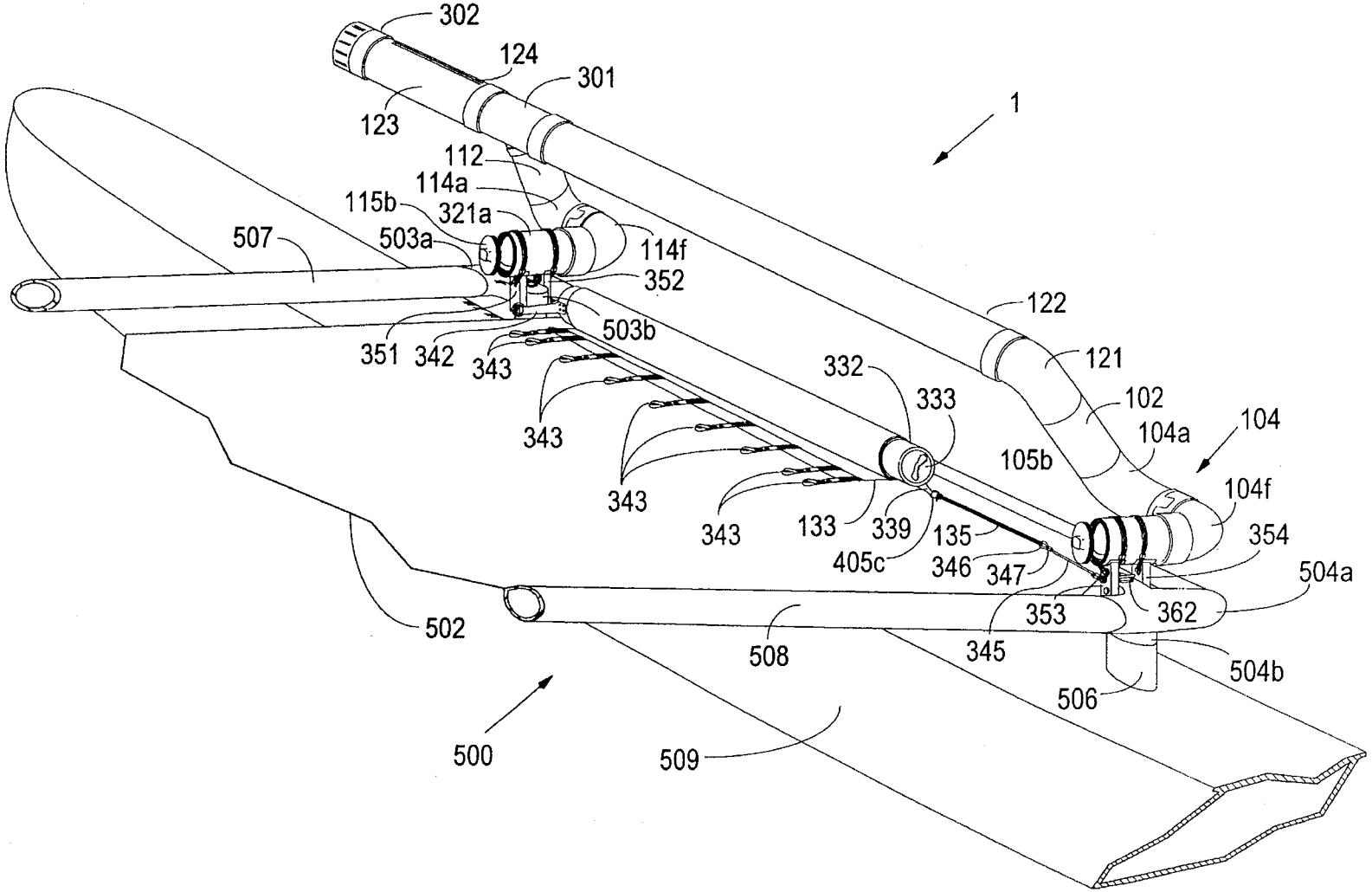
FIG. 1B is a perspective view of embodiment 1, shown in its folded-in or stowed position.
Figure 3C:
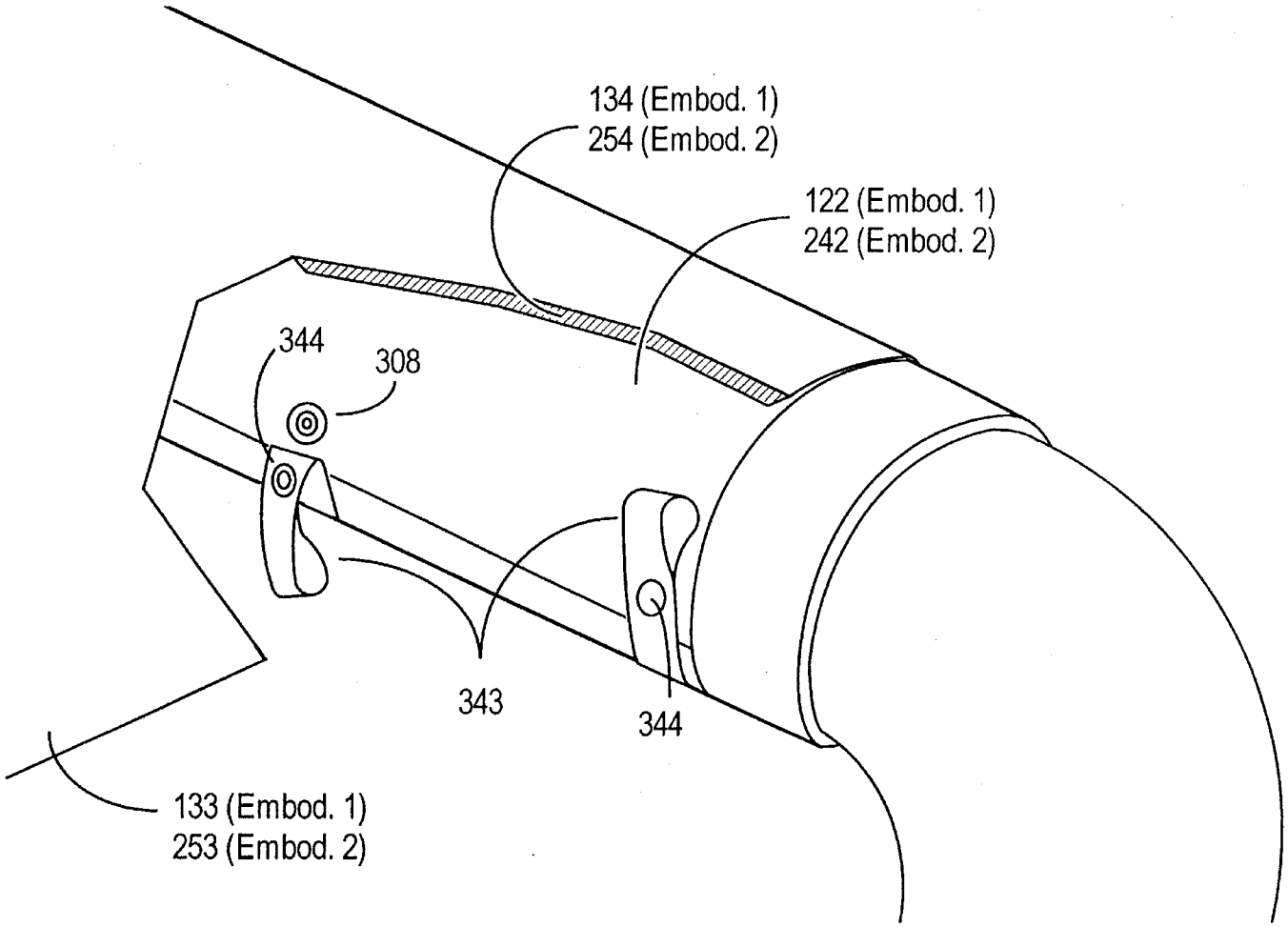
FIG. 3C illustrates the embodiment 1 main extension tube with a cut-away view showing trap seat attachment provisions.
Figure 3D:
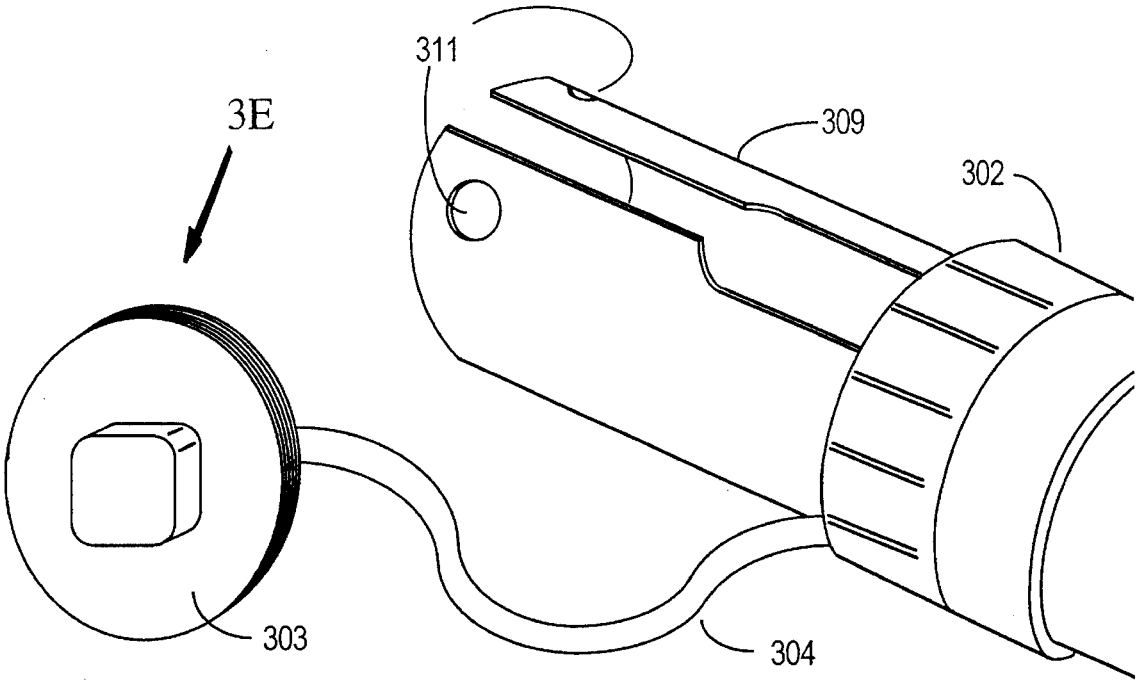
FIG. 3D is a perspective view of the elevated support rail internal storage tray in either embodiment, showing its slide-in/slide-out design.

FIG. 3C, applicable to both embodiments, illustrates the means employed to secure the trap seat along its outboard edge. As shown in this figure, the trap seat has been folded and sewn so as to form a wide seam that encloses a layer of outboard foam padding 134 in the case of embodiment 1, or a longer layer of outboard foam padding 254 in the case of embodiment 2. A set of sewn-on support straps 343 provides attachment of the trap seat along its outboard edge to a main extension tube 122 in the case of embodiment 1, or a main extension tube 242 in the case of embodiment 2. Each member of support straps 343 is spaced at regular intervals along the outboard edge of the trap seat, and incorporates one of a set of female snap fittings 344, as well as a loop of strap material. Each strap's female snap fitting is attached to a member of a set of screw-mounted male snap fittings 308. Male snap fittings 308 are positioned along the inboard-facing surface of the main extension tube. FIG. 1B reflects the stowed condition of the embodiment 1 trap seat. As shown in this figure, the embodiment 1 trap seat 133 employs 9 straps, with all straps spaced at regular intervals except for the pairs of straps closest to the forward and aft edges of the trap seat. The stowed condition of the embodiment 2 trap seat 253 is similar to that illustrated by FIG. 1B, except that trap seat 253 is longer than its embodiment 1 counterpart, and trap seat 253 incorporates an additional support strap for a total of ten.

Figure 3E:
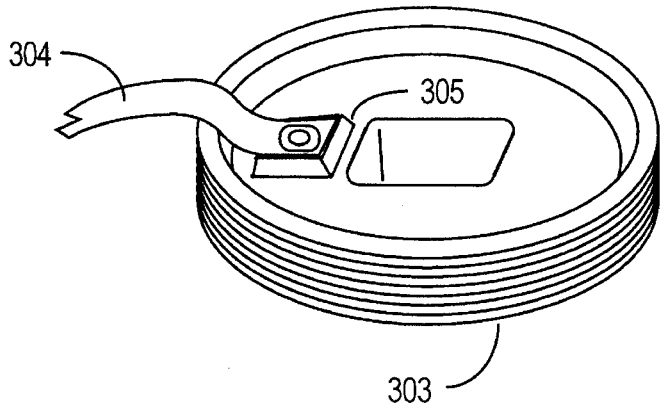
FIG. 3E is a view of the elevated support rail access cover showing cover strap attachment provisions.
Figure 3F:
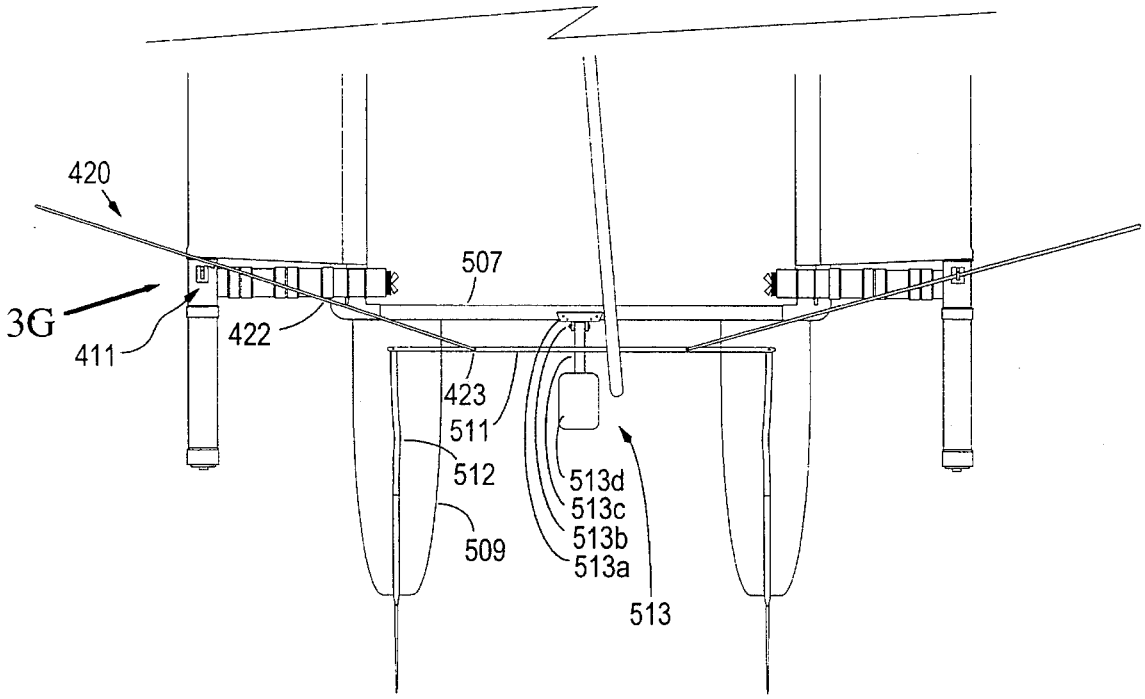
FIG. 3F is a view from above showing the dual tiller extension pole assembly and its attachment as part of embodiment 2.

In either embodiment, the aft end of the main extension tube is adhesively attached to a tubular T-fitting 301. FIG. 1B illustrates the embodiment 1 tubular T-fitting 301 and also shows its attachment to an aft extension tube 123. Embodiment 2, shown by FIG. 2A is of identical construction in this area, except that embodiment 2 has an aft extension tube 243 that is longer than the embodiment 1 aft extension tube 123. An adhesively-applied traction strip 124 in the case of embodiment 1, or 244 in the case of embodiment 2, is matched to the exposed length of the aft extension tube, and is positioned so as to maximize traction during trapezing. An aft end coupling 302 is adhesively attached to the aft extension tube of both embodiments, providing female threads that accept an elevated support rail access cover 303. FIG. 3E illustrates the attachment of the elevated support rail access cover to a retainer strap 304 by means of an adhesively attached screw pad 305, and a retainer screw and washer. At its opposite end, retainer strap 304 is clamped and glued into a small gap provided between the aft end coupling 302 and the aft extension tube.

Figure 3G:
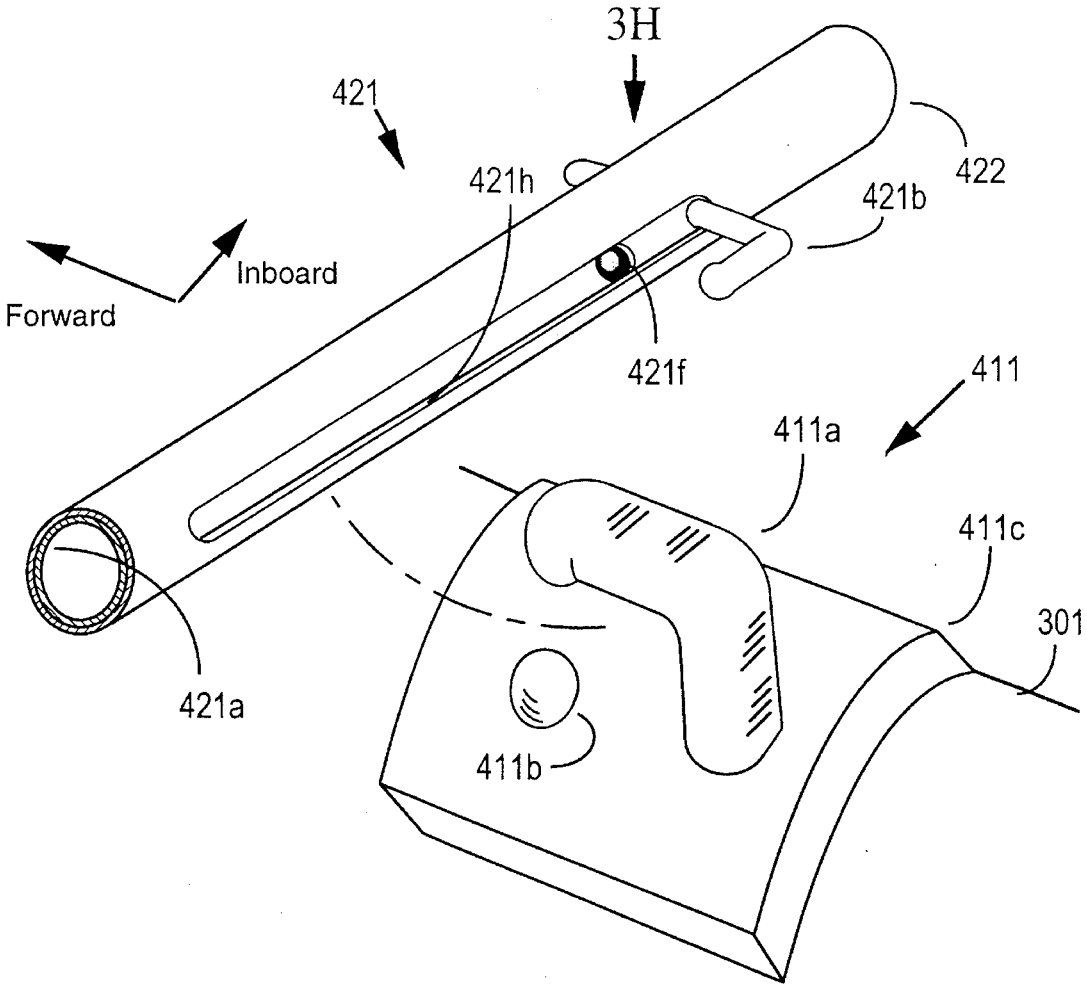
FIG. 3G is a perspective view of a tiller extension pole guide.

Tubular T-fitting 301 also serves as a preferred location for a tiller extension pole guide assembly 411 used by one side of the catamaran's dual tiller extension pole rudder control assembly 410 and depicted by FIG. 3F. Tiller extension pole shaft 422 rides in guide assembly 411 and is pivotably attached at its inboard-reaching end to tiller cross bar 511. FIG. 3G provides a detailed view of guide assembly 411 showing it in relation to an adjustable catch assembly 421 attached at the outboard-reaching end of tiller extension pole shaft 422. Guide assembly 411 consists of a guide base 411*c* that is solidly attached to tubular T-fitting 301, an extension pole retainer hook 411*a* extending from guide base 411 and projecting forward to a location directly over tiller extension pole detent 411*b*. Adjustable catch assembly 421 consists of a slider tube 421*a* sized to snugly fit inside tiller extension pole shaft 422. As shown in detail in FIG. 3H, a catch hook 421*b* extends through slider tube 421*a* and has a portion bending so as to extend parallel to extension pole shaft 422 and outboard. Catch hook 421*b* has a hole in a portion of its shaft internal to slider tube 421*a*, through which a leaf spring 421*d* is passed. Leaf spring 421*d* is retained at its inboard and outboard ends by retainer plugs 421*e* and 421*d* respectively.

Both embodiments 1 and 2 provide an enclosed space comprised by cylindrical walls of the aft end coupling 302, the aft extension tube, the tubular T-fitting 301, and the main extension tube. FIG. 3D illustrates components internal to this storage space, showing a cylindrical storage tray 309 that can be inserted or removed by way of the elevated support rail access cover 303. The storage tray 309 incorporates a pair of finger holds 311.

Figure 2B:
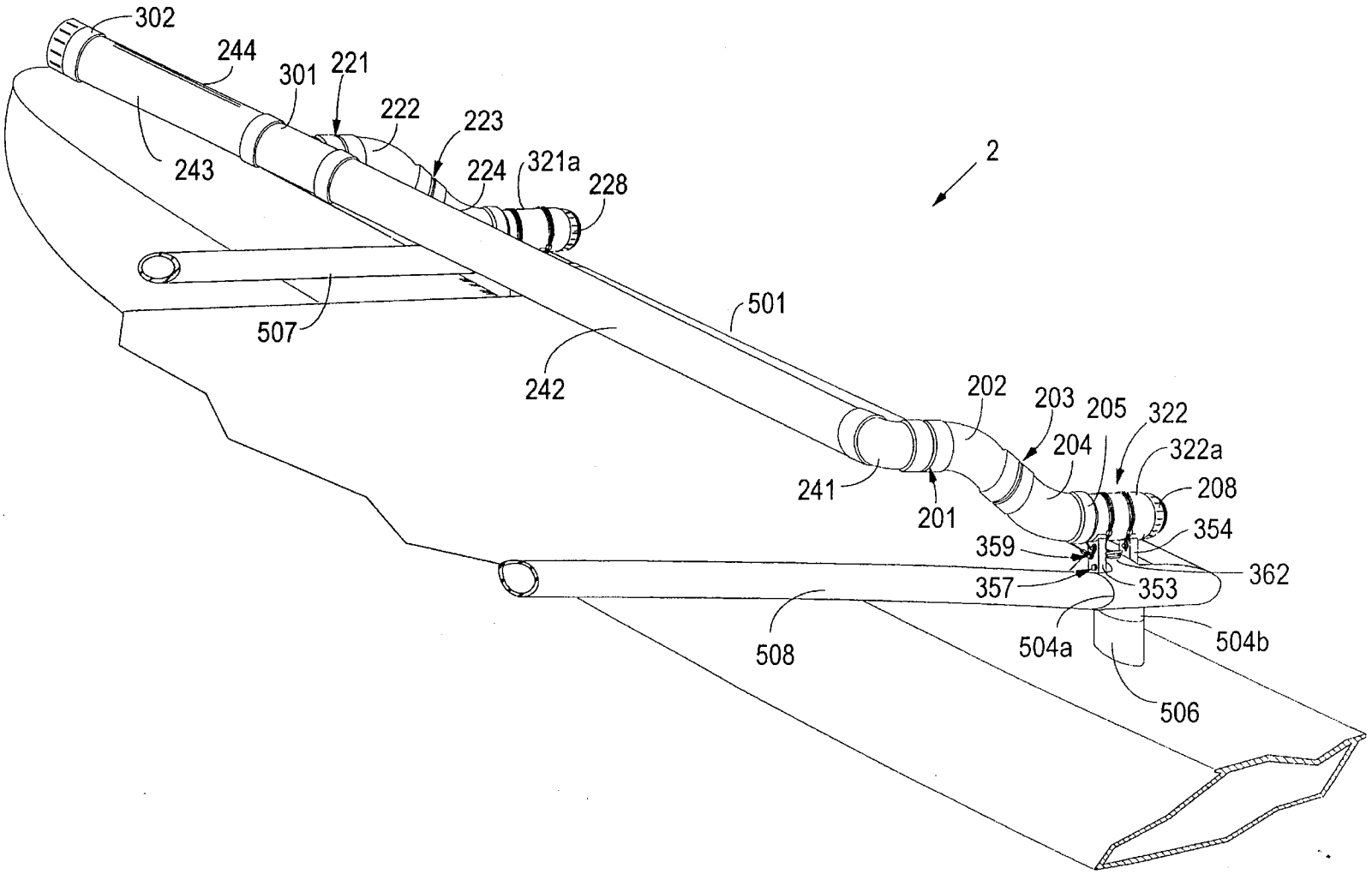
FIG. 2B is a perspective view of embodiment 2, reversed and slide-mounted into its stowed position.

Outboard strapped-on coolers are also provided by each embodiment, as shown in FIG. 1A for embodiment 1, and FIG. 2A for embodiment 2. Attachment details for an embodiment 2 outboard cooler 261 are shown by FIG. 2D. Although mounted aft instead of forward, an embodiment 1 cooler 141 employs attachment techniques that may also be discussed by analogy to FIG. 2D.

As illustrated by FIG. 2D, a pair of cooler outer suspension straps 262 and a center suspension strap 263 attach to the main extension tube 242 in the same fashion as trap seat support straps 343 shown by FIG. 3C. Extending inboard from the main extension tube, straps 262 and 263 run down the outboard wall of the cooler 261 and wrap under its base. Each of the straps 262 and strap 263 is attached to the outboard cooler wall by two strap attachment bolt assemblies, and again to the underside of the cooler by two strap attachment bolt assemblies. An aft-underside-inboard strap attach bolt assembly 384, shown by FIG. 3F is typical, consisting of a cooler strap attach bolt 384*a*, a pair of cooler strap washers 384*b*, and a cooler strap locking nut 384*c*. Cooler strap washers are preferably made of a plastic material such as nylon, and are adhesively attached so as to reinforce the cooler walls and strapping in the attachment bolt areas. Straps 262 and 263 are also reinforced, in this case by adhesive attachment to the cooler wall, and by an overlay of strap material in the areas secured by attachment bolt assemblies. As shown by FIG. 2A, the outer suspension straps 262 extend inboard from the cooler, wrap around the forward tension rope 255 and forward tension cable 345, and then extend back along their lengths, where they are secured by a pair of mounting strap buckles 383. Unlike straps 262, the center suspension strap 263 does not extend inboard from the cooler, and only serves to reinforce the cooler attachment to the main extension tube. As shown in FIG. 3F, the outboard cooler 261 is oriented longitudinally parallel to the main extension tube 242, with the cooler cover hinged so as to swing upwards and outboard. A cooler cover lid seal 381 is also incorporated, providing watertight integrity when the cooler cover is closed and latched.

The embodiment 1 outboard cooler 141 shown in FIG. 1A, has the same dimensions as the embodiment 2 outboard cooler 261 and is also watertight due to the incorporation of a cover lid seal 381. Outboard cooler 141 is located and oriented differently than the embodiment 2 outboard cooler 261, however, in that it has been rotated 90° so as to fit in the rectangular area bounded by embodiment 1 main extension tube frame elements and the aft edge of the trap seat 133. Oriented as shown, the outboard cooler 141 is longitudinally perpendicular to the main extension tube, with the cooler cover hinged so as to swing upwards and aft. Although located and oriented differently, the embodiment 1 outboard cooler mounts in similar fashion to the embodiment 2 cooler. More specifically, the embodiment 1 outboard cooler 141 is attached to straps 142 and 143 using strap attachment bolt assemblies such as 384 described with respect to FIG. 3F. Extending inboard from the underside of cooler 141, the straps 142 wrap around the existing catamaran aft mounting elbow 503*a* and trampoline support rail 501. Straps 142 then extend back along their original paths and are secured by a pair of mounting strap buckles 383.

Although similar in most of their above described characteristics, embodiments 1 and 2 differ substantially in their method of stowage and deployment of outboard wing elements. FIG. 1A and FIG. 1B pertain to embodiment 1 showing a fold-in/fold-out deployment concept in its deployed and stowed positions, respectively. FIG. 2A and FIG. 2B pertain to embodiment 2 showing a slide-in/slide-out deployment concept in its deployed and stowed positions respectively. The aft and forward support arm mounts 321 and 322 serve as the inboard foundation for both deployment concepts, respectively mounting atop the aft and forward mounting strut assemblies as previously described in the discussion of FIG. 3A. From this point, substantial differences between the embodiment 1 and embodiment 2 designs have been incorporated in order to implement their differing deployment concepts.

Figure 1C:
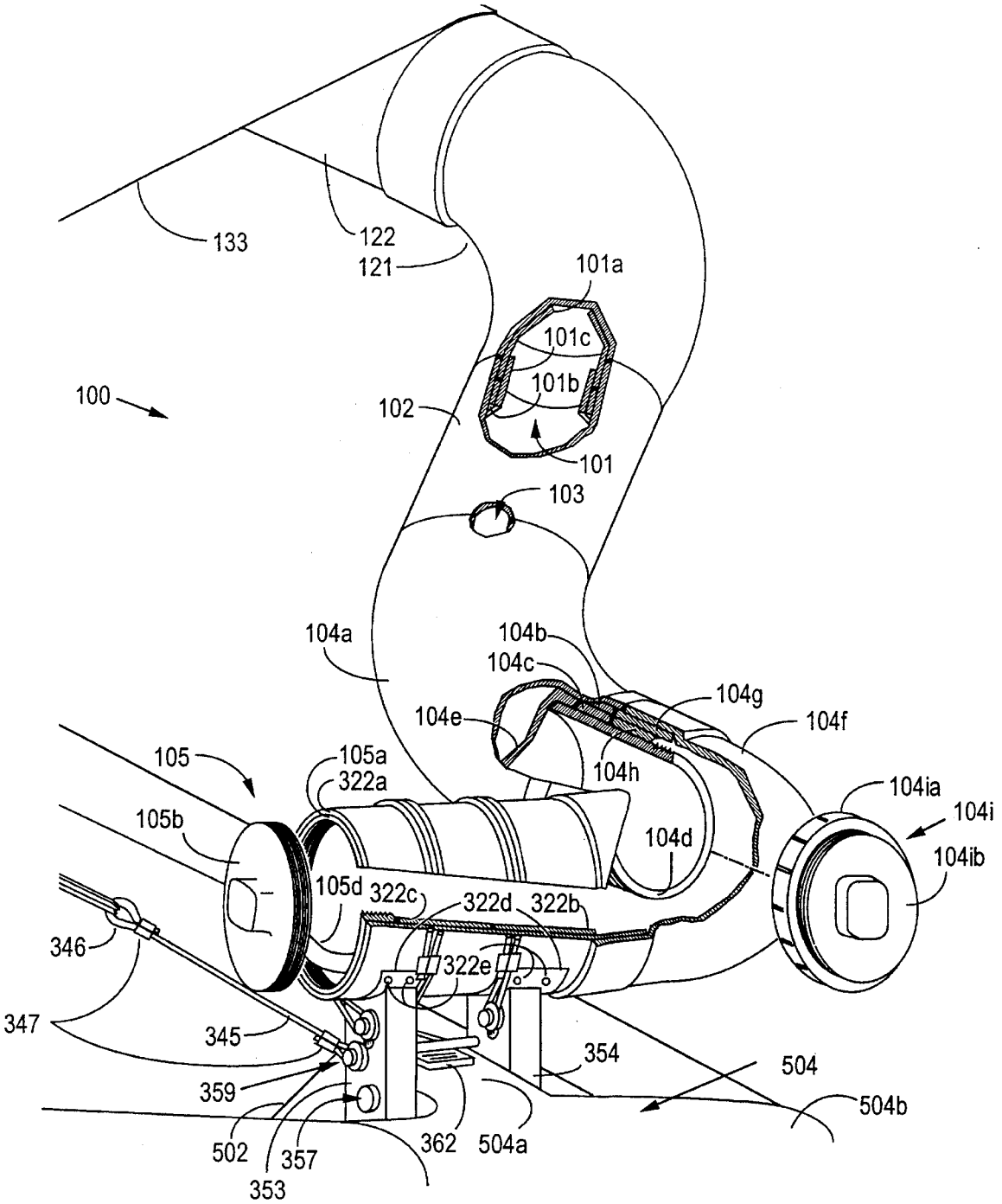
FIG. 1C is a cut-away perspective view of the forward support arm design employed by embodiment 1, shown in the folded-out position.

FIG. 1C shows design details of a forward support arm assembly 100 that consists of a forward swivel lock assembly 104, a lower internal attach tube assembly 103, a forward arm tube 102, and an upper internal attach tube assembly 101. Upper internal attach tube assembly 101 provides a method of attaching forward arm tube 102 and a forward corner 45° male/female tubular fitting 121 in a fashion that is more aesthetic that a standard externally protruding male/female pipe joint. For this purpose, attach tube assembly 101 consists of an upper attach tube 101*a*, a middle upper attach tube 101*b*, and an upper through-tube 101*c*. Lower internal attach tube assembly 103 is identical to attach tube assembly 101, and serves to attach the forward arm tube 102 at its inboard end, to the forward swivel-lock assembly 104. Forward swivel-lock assembly 104 is shown in cutaway section in both FIG. 1C and FIG. 1D. Outboard elements of the forward swivel-lock assembly are adhesively attached to one another and include; an outboard 45° male/female tubular fitting 104*a* connecting to attach tube assembly 103, an outboard liner ring 104*b* connecting inside the inboard female end of 45° male/female tubular fitting 104*a*, an outboard inner liner ring 104*c* connecting inside the liner ring 104*b*, a swivel-lock through-tube 104*d* connecting inside the inner liner ring 104*c*, and an inner end cap 104*e* connecting over the outboard end of the through-tube 104*d*. Inboard elements of the forward swivel-lock assembly are likewise adhesively attached to one another and include; an inboard 90° female/female tubular fitting 104*f* connecting at its inboard end to tubular mount 322*a*, an inboard liner ring 104*g* connecting inside the outboard female end of the 90° female/female tubular fitting 104*f*, and an inboard inner liner ring 104*h* connecting inside the liner ring 104*g*. The forward swivel-lock assembly is completed by an inner ring nut 104*ia* and inner ring nut plug 104*ib*, that are adhesively attached together to form a removable wing locking cap 104*i* that screws onto the inboard threaded end of the swivel-lock through-tube 104*d*.

The forward support arm assembly 1.00 is completed by a tubular mount closure assembly 105 consisting of elements particular to embodiment 1 that allow the forward support arm assembly 100 and forward support arm mount 322 to be used for cubby hole storage. As shown in FIG. 1C, tubular mount closure assembly 105 consists of a tubular mount end coupling 105*a* that adhesively attaches inside the inboard end of tubular mount 322*a*, a tubular mount access cap 105*b* that screws into the threaded end provided by the end coupling 105*a*, an access cap screw pad 105*c* (not shown) that adhesively attaches to the inside surface of the access cap 105*b*, and a retainer strap 105*d* that is secured by retainer strap screws and washers to the access cap screw pad 105*c* and the inner surface of forward support arm mount 322.

An aft support arm assembly 110 is substantially similar to the forward support arm assembly 100, consisting of an aft arm tube 112 that attaches to the inboard-facing female end provided by tubular T-fitting 301, an internal attach tube assembly 113 that is adhesively attached to the inboard facing end of the aft arm tube 112, an aft swivel-lock assembly 114 connecting outboard to attach tube assembly 113 and inboard to aft tubular mount 321*a*, and an aft tubular mount closure assembly 115. The internal attach tube assembly 113 and aft tubular mount closure assembly 115 are physically and functionally identical to the lower internal attach tube assembly 103 and forward tubular mount closure assembly 105 employed by the forward support arm assembly. The aft support arm assembly 110 differs from the forward support arm assembly 100 in that it incorporates an aft arm tube 112 that attaches directly to the inboard-facing female end of tubular T-fitting 301, whereas the forward arm tube 102 attaches to the male end of the forward corner 45° male/female tubular fitting 121 using internal attach tube assembly 101. The aft support arm assembly 110 also differs in that its aft swivel-lock assembly 114 incorporates an outboard swivel-lock 90° male/female tubular fitting 114*a* instead of an element such as the forward support assembly's 45° male/female tubular fitting 104*a*. As a result, the aft arm tube 112 extends perpendicularly from the side of the catamaran, whereas forward arm tube 102 is swept backward at a 45° angle. A set of sub-elements 114*b* through 114*j* complete the aft support arm assembly and are physically and functionally identical to their respective forward support arm assembly counterparts 104*b* through 104*j*.

Figure 2C:
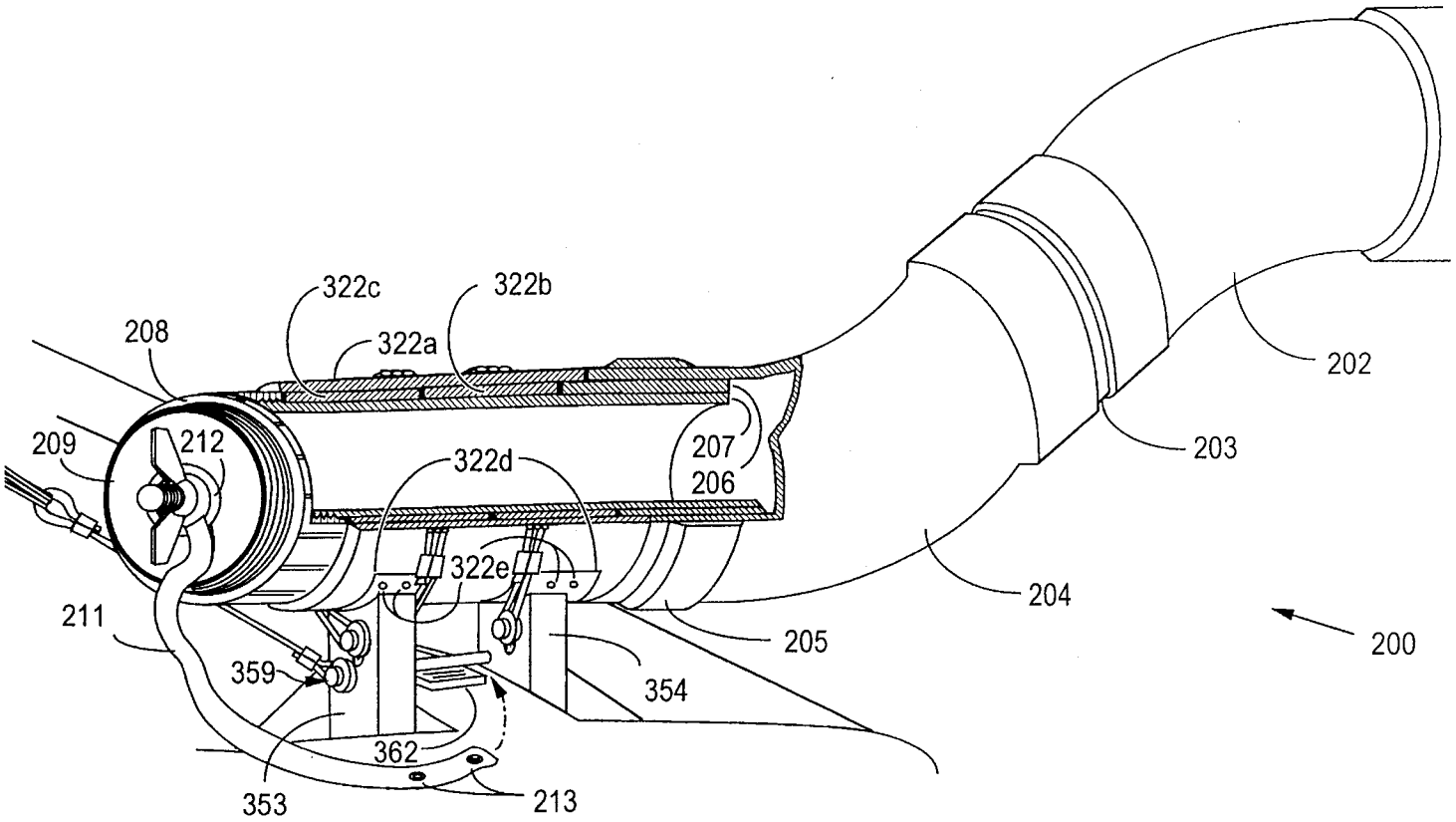
FIG. 2C is a cut-away perspective view of the forward support arm design employed by embodiment 2.
Figure 2D:
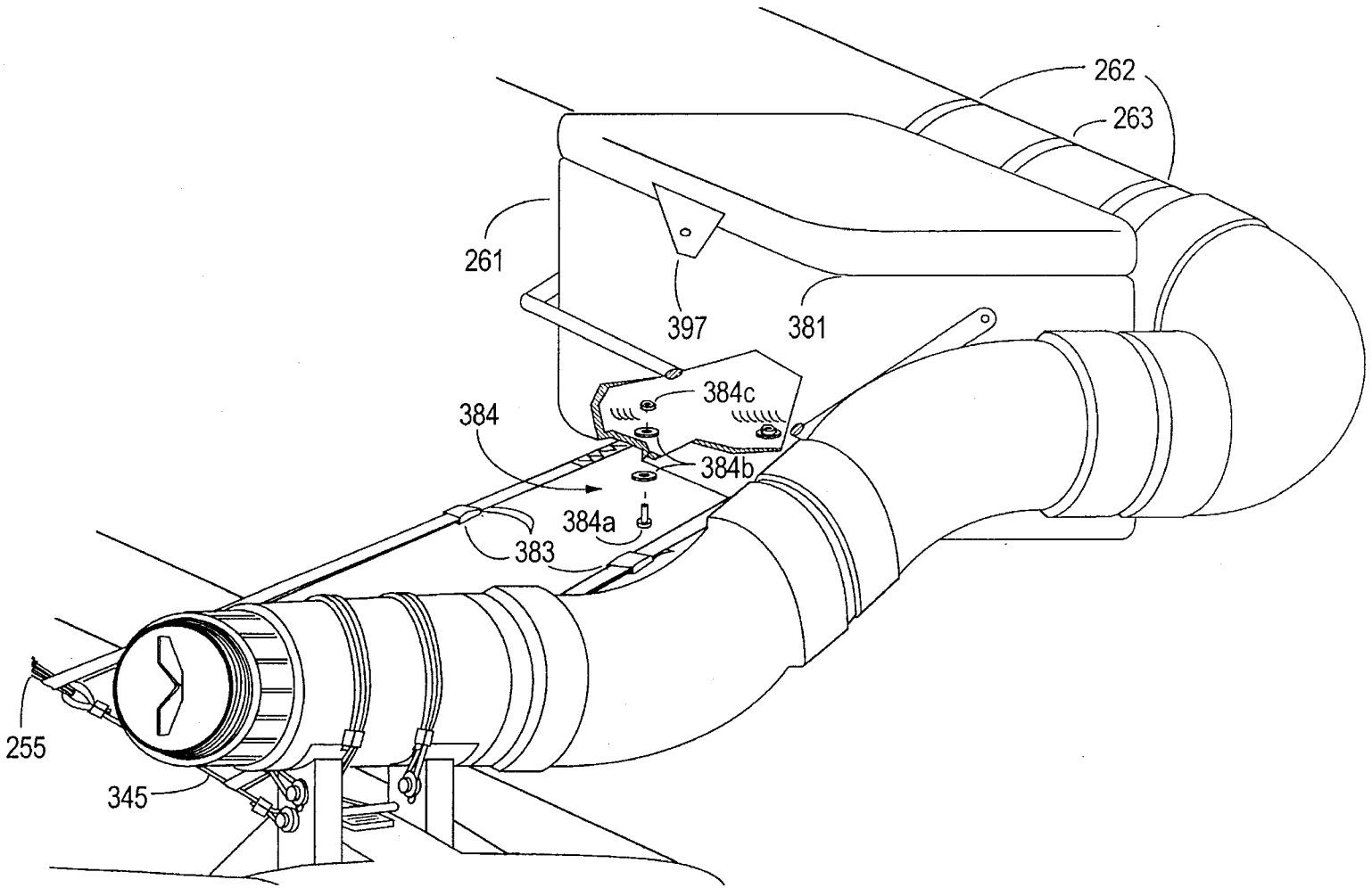
FIG. 2D illustrates the embodiment 2 watertight cooler with a cut-away view showing cooler mounting strap attachments.

FIG. 2C provides a cut-away detail of an embodiment 2 forward support arm assembly 200 that provides for slide-in/slide-out deployment. Unlike the embodiment 1 configuration, forward support arm mount 322 is not adhesively attached to the forward support arm assembly 200, but is used as a female receptacle for an inboard-extending inner mounting tube 207. At its inboard end, the inner mounting tube 207 is threaded, and mates to an inner mounting tube ring nut 208. When tightly secured, ring nut 208 applies tensional force to the inner mounting tube 207 and prevents the forward support arm assembly from slipping outboard. A commonly available non-metallic expandable dollar plug or expanding plug 209 seals the inboard-facing end of the inner mounting tube 207. A plug strap 211 has one end sewn to a plug strap attach ring 212, that encircles the oversize plastic wing nut of expanding plug 209. At its other end, (shown removed) the access plug strap is looped over the forward upper through bolt 359, re-attaching to itself by means of a male/female snap fitting pair 213. At its normally outboard end (as shown in FIG. 2C), inner mounting tube 207 adhesively attaches to an inner mounting tube sleeve 206. The inner mounting tube sleeve is bonded to an inboard 45° male/female tubular fitting 204 in non-standard fashion, adhesively attaching to the inside cylindrical wall of the tubular fitting's male end. A reinforcement band 205 adhesively attaches to the outside cylindrical wall of the male end of 45° tubular fitting 204. The female end of tubular fitting 204 extends upwards and outboard attaching to an inboard joiner tube 203, that is in turn adhesively attached to the inboard-facing female end of an outboard. 45° female/female tubular fitting 202. The outboard facing female end of tubular fitting 202 is then adhesively attached to an outboard joiner tube 201, which completes the forward support arm assembly. Attachment of the forward support arm assembly to the main extension tube 242 is then accomplished as shown in FIG. 2A by a forward comer 90° female/female tubular fitting 241 that adhesively attaches to the main extension tube at its aft-facing end, and adhesively attaches to the outboard joiner tube 201 at its inboard-facing end.

An embodiment 2 aft support arm assembly 220 slide mounts into the aft support arm mount 321 and consists of a collection of components 221 through 233 that are physically and functionally identical to the respective components 201 through 213 of the forward support arm assembly 200. Attachment of the embodiment 2 aft support arm assembly 220 to the elevated support rail is accomplished by tubular T-fitting 301, which is adhesively attached at its inboard, aft, and forward facing ends to the aft support assembly's outboard joiner tube 221, the aft extension tube 243, and the main extension tube 242, respectively.

Both embodiments 1 and 2 employ standard 3" and 4" PVC tubular fittings, in some cases machined so as to combine together in non-standard fashion. As a result, the described embodiments are tailored for construction using commonly available materials. It is recognized that more aesthetic, functionally improved, lighter embodiments may also obtained by the use of molded parts which eliminate glued joints. With respect to FIG. 1C for example, the upper internal attach tube assembly 101, forward arm tube 102, and lower internal attach tube assembly 103, of the embodiment 1 forward support arm assembly 100, can all be replaced by a single molded fitting.

OPERATION—FIGS. 1A–3F

Although a number of separate elements combine in the present invention, it is emphasized that these elements interact in a complimentary, synergistic fashion. These complimentary interactions include the following:

(a) Aft extension tubes provide for counterbalancing against submarining of the downwind bow, but also increase total storage space and buoyant righting moment.

(b) Large diameter wing frame tubing provides internally-disposed watertight storage, but also provides a number of other benefits, including; increased buoyant righting moment, secure footing when trapezing, and rounded broad surfaces less likely to bruise a sailor in the event of a spill. The large cross-sectional areas of wing frame elements additionally provide structural rigidity that allows the use of low cost, corrosion-proof plastic construction.

(c) Watertight outboard coolers serve to increase insulated storage space, but also provide additional seating surfaces, and supplement the total buoyant righting moment. Large diameter wing tubing substantially braces and shields the coolers against the impact of the water in the event that a wing dips into a wave as a result of excessive heeling.

(d) A trap seat cooler tube provides for storage of drinks but also secures the trap seat above water that occasionally splashes over the trampoline. The rounded shape of the cooler tube is comfortable to sit on, especially when wrapped with insulating padding that serves the combined purpose of seat padding and thermal insulation. When subject to the weight of one or more sailors, the cooler tube and trap seat form a secure bucket that reduces leg strain required to prevent the sailors from sliding inboard.

(e) The dual tiller assembly employs the elevated wing structure to support the tillers and in particular, prevents the downwind tiller from being dipped in to the water when the catamaran is heeled for optimum performance.

A shared wing mounting gear design plays a key role in all the above noted interactions by providing structural rigidity sufficient for carrying three passengers, or for onshore dragging, lifting, or up-ending of the sailboat. FIG. 3A illustrates aft mounting strut assembly characteristics that provide structural rigidity against a variety of applied forces. Lower through bolt assembly 356 is a key load bearing element, taking advantage of a single existing bolt hole in each trampoline support pylon. As a result, the mounting strut assembly installs without drilling or machining of existing sailboat elements, and can be quickly removed for class-legal participation in sailing club racing activities. An upper through bolt assembly 358 provides stability to the assembly, without penetrating the existing pylon cap **503*b*. Note: when installing the mounting strut assembly, lower through bolt 356 is tightened first, and upper through bolt 358 is tightened second, so as to avoid leveraging of tension against the smaller diameter upper through bolt 358**. Detailed operation of the mounting strut assembly is described in terms of the following orthogonally-applied forces:

(a) In response to a downward force on the outboard wing structure, strut 352 is pushed down and strut 351 is pulled up, each strut applying a vertical shear force to the shaft of lower through bolt assembly 356. These vertical shear forces are reversed if an upward force is applied to the outboard wing structure.

(b) If horizontal forces are applied to wing frame elements so as to push or drag the boat in the aft direction, a resulting aft-directed force is applied to the upper ends of both struts 352 and 351, causing rotational torque about the axis provided by lower through bolt assembly 356. As viewed from FIG. 3A this torque is counterclockwise about the lower through bolt axis, and is counteracted by support bushing 361 bearing upward against the shaft of the upper through bolt assembly 358.

(c) If a horizontal force is applied to a wing frame element so as to push or drag the boat in the forward direction, a resulting forward-directed force is applied to the upper ends of both struts 352 and 351, causing rotational torque about the axis provided by lower through bolt assembly 356. As viewed from FIG. 3A this torque is clockwise about the lower through bolt axis, and is counteracted by the existing geometry of the pylon cap **503*b*. More specifically, pylon cap 503*b* inboard and outboard vertical surfaces are not oriented in parallel planes but tend to converge due to a tapering of the transverse thickness of the pylon cap in the aft direction. The leading vertical edges of the mounting struts are therefore slightly farther apart than the associated trailing vertical edges. As a result, the clamping action of the upper through bolt 357** serves to effectively resist forward rotation of the mounting strut upper ends about the lower through bolt axis.

(d) If a force is applied to a wing frame element so as rotate the boat horizontally in place, the aft support arm mount 321 will be subject to an outboard directed pulling force, or an inboard-directed pushing force that is applied substantially in line with the tubular mount axis. Inboard or outboard slippage of the tubular mount under these conditions is prevented by the clamping action of hold-down cable assemblies, and by set screws 355*a* and 355*b* which each protrude upward into a hole in the lower wall of the tubular mount.

Although not illustrated in detail, analogous elements of the forward mounting strut assembly operate similarly to their aft mounting strut assembly counterparts discussed above.

Forces applied to the wing are transferred to the mounting strut assemblies by means of hold-down cable assemblies such as 373, which is typical of the forward and aft hold-down cable assemblies employed by both embodiments. To remove free-play in the hold-down cable assembly 373, set screw 355*a* is tightened so as to pre-load the cable with several hundred pounds of tension. Cable anchor bolt locking nut 373*f* is then tightened, placing the anchor bolt 373*c* under sufficient tension to prevent bending caused by the downward pressure of set screw 355*a* against the anchor bolt shaft. Cable anchor bolt washers 373*e* sandwich or bracket the cable eyes and are doubled so as to prevent substantial deformation of the washers as the cable anchor bolt nut is tightened. Cable anchor bolt sleeves 373*d* are preferably made of a compressible material that conforms to the shape of the cable and prevents the cable from contacting the anchor bolt 373*c* shaft or threads. As the hold-down cables are tightened, aft support arm mount 321 undergoes compression and would ordinarily tend to assume a significantly elliptical cross section. To minimize this tendency, support arm mount 321 incorporates double-wall thickness so as to substantially maintain a circular cross section as the hold-down cables are tensioned. All hold-down cable loops are sized so that when their associated set screws are fully tightened, the upper ends of the set screws are recessed below the inner wall of the support arm mount assembly. For clarity in FIG. 3A, set screw 355*a* is shown prior to being fully tightened. Once all set screws are fully tightened, the full internal volumes of their associated tubular mounts are available for use as cubby-hole storage.

FIG. 1C shows a typical embodiment 1 cubby-hole storage volume, consisting of the combined internal volume of forward support arm mount 322 and the lower portion of the forward swivel lock assembly 104. The storage volume is easily available via access cap 105*b* when sailing, and access cap 105*b* is secured against loss by retainer strap 105*d*. A smaller volume, internal to the swivel-lock through-tube 104*d* can also be employed for secure storage of small, infrequently-accessed valuables such as car keys, or replacement parts. This smaller storage volume is accessible via the wing locking cap 104*i* formed by the inner ring nut 104*ia* and inner ring nut plug 104*ib*. FIG. 2C shows cubby-hole storage space typical of the embodiment 2 design. In this case, the internal volume of the inner mounting tube 207 and forward support arm assembly 100 combine to form stowage space accessible by expanding plug 209. Expanding plug 209 is easily removable when sailing and the associated plug strap 211 allows expanding plug 209 to reach and be inserted in the open end of the inner mounting tube 207, in either the stowed or deployed wing positions. With a cubby-hole storage space accessible through the inboard facing end of each of their four support arm mounts, both embodiments provide storage capacity sufficient for a variety of items desirable for a day-sailing excursion or for camping. In typical operation, these cubby hole storage spaces also provide a convenient place for stowage of empty beverage containers, as additional beverages are drawn from the trap seat cooler tubes.

Embodiment 1 and 2 trap seat cooler tubes operate identically. FIG. 3B shows the initial state of the cooler tube prior to loading of canned or bottled beverages. As beverages and ice are sequentially inserted into the open forward end coupling 332, pull cylinder 337 and retrieve strap 335 are displaced aft into the tube. When sailing, the contents of the tube are easily available via cooler tube access cover 333. In operation, retrieve strap 335 serves the combined purpose of allowing beverages to be drawn out in train, and preventing the cooler tube access cover 333 from being lost. As part of the trap seat frame, the cooler tube must be placed in substantial tension. FIG. 1A illustrates how this is accomplished by a forward tension rope, whose several turns wrap through the cooler tube forward strap 339 attach ring and the cable eye sleeve of the forward tension cable 345. With tension applied, the dual aft cooler tube straps 342 and 341 act to prevent rotational movement of the cooler tube about its longitudinal axis. Additional tension is also applied when the trap seat is stretched outboard and attached to the main extension tube, and the total amount of tension applied is sufficient to prevent substantial outboard cooler tube movement when the trap seat is fully loaded.

When fully deployed, the trap seat is pulled tight enough to prevent sagging and promote drainage if splashed. FIG. 3C shows strap 343 loops employed to apply tension to the trap seat. By pulling on these strap loops, the trap seat is manually drawn over the main extension tube and tensioned so as to remove all wrinkles. Male snap fittings 308 are positioned so as to require full tightening of the trap seat before attachment to the respective female snap fitting can be accomplished. In operation, the trap seat forms a comfortable bucket under the load of a seated passenger. Due to a small amount of flex in the trap seat supporting frame, the trap seat fully regains its original flat appearance when unloaded. Additional comfort is also provided by the cooler tube insulating padding wrap and by the outboard foam padding which wraps the main extension tube. The outboard foam padding 134, for embodiment 1, or 254 for embodiment 2, also provides a softer, more secure footing surface when trapezing.

Trapezing from the aft, outboard end of the sailboat is provided for by the aft extension tube 123 as shown by FIG. 1A in the case of embodiment 1, or by the somewhat longer aft extension tube 243 shown by FIG. 2A in the case of embodiment 2. In both cases, a substantial amount of leverage can be applied aft of previously available trapezing locations, reducing the tendency of the sailboat to pitch forward in a high wind.

The aft-directed extension provided by the aft extension tube augments the storage space provided by the main extension tube. The initial condition of this storage volume, prior to loading is illustrated by FIG. 3D. In order to load the storage volume, storage tray 309 is drawn aft and removed using finger holds 311. Using a longitudinal access slot cut located along the upper length of the storage tray, rolled blankets, towels, clothing, picnic supplies, or other suitable items may be inserted. Storage tray 311 is then re-inserted, and elevated support rail access cover 303 is screwed into the aft end coupling 302, so as to form a watertight seal. Due to its location on the sailboat, this storage area is intended for access after the sailboat is beached. Once beached, storage tray 311 allows all stored items to be removed at once and carried to a camp or picnic location. Retainer strap 304 prevents the elevated support rail access cover 303 from being lost during the removal and re-insertion of the storage tray.

Outboard coolers 261 in the case of embodiment 2, and 141 in the case of embodiment 1, are readily accessible while sailing, but are also detachable for use at a picnic site. Commercially available strap attach buckles 383 shown in FIG. 3F facilitate this process, by providing quick detachment of the inboard reaching strap portions. Cooler support straps connected to the main extension tube are also quickly detachable, using the same method illustrated by FIG. 3C with respect to the trap seat. Although quickly detachable, the cooler is substantially protected from the impact of the water by adjacent large diameter tubing and will not be jarred loose if the boat heels over. During a capsize, watertight seals 381 prevent flooding of a submerged cooler and cooler latch 397 prevents the cooler lid from swinging open. Attachment straps, buckles, and fastening snaps are sufficiently strong to withstand the shock of a capsize, and during normal sailing allow the cooler to be used as an additional seating surface. Embodiment 1 and 2 differ substantially in the location of the cooler, with the embodiment 1 cooler located aft and the embodiment 2 cooler located forward. The cooler location of embodiment 1 is better suited to solo-sailing, allowing the helmsman to readily access the cooler without releasing the tiller or moving from his preferred position at the aft, outboard end of the sailboat. The cooler location of embodiment 2 is better suited to sailing with more than one person, and provides a convenient seat from which a forward crew member can view the bottom in shallow water.

Figure 3H:
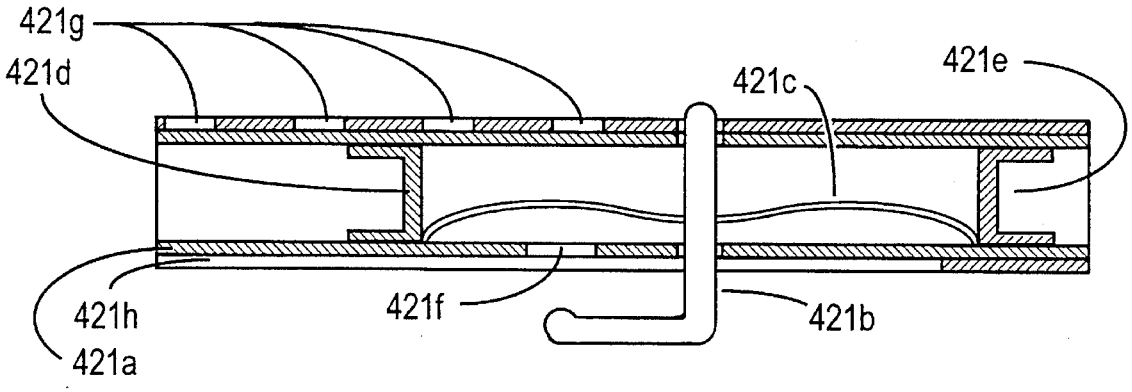
FIG. 3H is a sectional view of a tiller extension pole showing internal components of adjustable catch assembly.

Both embodiments benefit from the use of the dual tiller extension pole assembly for rudder control shown in detail by FIG. 3F. When sailing upwind on a port tack the helmsman will be seated on the port side of the catamaran and will employ filler extension pole 420. At the same time, the opposite-side tiller extension pole 420' rides in its tiller extension pole guide on the opposite-side elevated wing structure. In preparation for a tack the helmsman will grasp the tiller extension pole and push it laterally through the opening above extension pole detent **411*b*. Extension pole detent 411*b* compresses during insertion of the extension pole but resumes its original profile afterward so as to prevent the extension pole from easily moving forward through the same opening. By grasping the tiller pole just above catch-hook 421*b* the helmsman can also depress the catch hook 421*b* shaft with his thumb while inserting the tiller extension pole into the guide assembly 411. FIG. 3H shows a sectional view of the adjustable catch assembly 421 with the catch hook 421*b* shown in its fully depressed position, and the hook portion of the catch hook 421*b* extended so as to engage the tiller extension pole retainer hook 411*a*. By pulling outboard on the tiller extension pole while depressing the catch hook 421*b* shaft, the catch hook will engage the tiller extension pole retainer hook 411*a*. Once engaged, a nub on hook portion of catch hook 421*b* serves to resist disengagement. At that point, natural force applied by the rudders against the tiller extension pole causes the catch-hook to remain engaged during the initial stages of the tack. Once the bows of the sailboat have crossed the eye of the wind, the helmsman can immediately move to the opposite side of the sailboat without pausing to pivot the tiller extension pole as required by existing rudder-control arrangements. Once on the opposite side of the sailboat the hehnsman can release the rudders by pulling the opposite-side tiller extension pole 420' outboard. This causes catch hook 421*b* to disengage from the tiller extension pole retainer hook 411*a*. Once disengaged, spring 421*c* causes the catch hook to return to its original position, preventing interference with tiller extension pole retainer hook 411*a* as the rudders are operated. If desired, the helmsman can adjust the longitudinal location of the catch hook 421*b* on the extension pole shaft 422 in order to preset the angle to be used during the next tacking process. With respect to FIG. 3H, this is accomplished by grasping the hook portion of catch hook 421*b* and pulling until spring 421*c* contacts the inner wall of slider tube 421*a*. At this point, the shaft portion of catch hook 421*c* is recessed inside the wall of tiller extension pole shaft 422, releasing the slider tube 421*a* for movement. A slot 421*h* is provided to accommodate the catch hook shaft as the slider tube 421*a* is moved. At a new desired location, the position of the slider tube 421*a* can be locked by insertion of the catch hook shaft in one of the catch position adjust holes 421*g***.

Figure 1D:
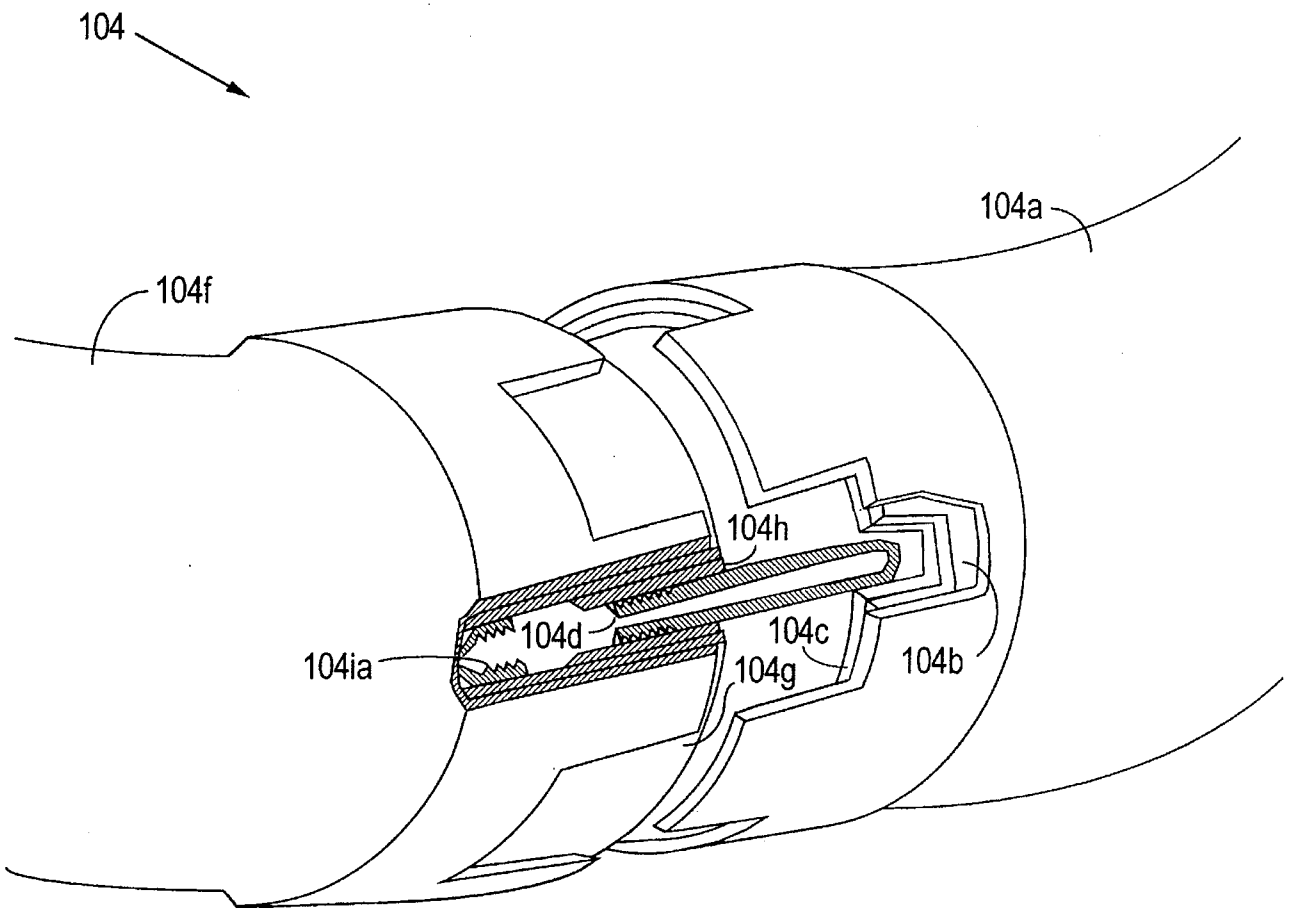
FIG. 1D is a side view showing cut-away details of the forward support arm swivel-lock joint design employed by embodiment 1.

Although similar in most respects, embodiments 1 and 2 differ substantially with regard to their method of stowage and deployment when trailering the sailboat. The fold-in/fold-out stowage deployment method of embodiment 1 is initially described with respect to FIG. 1C showing the deployed position. To prepare embodiment 1 for trailering, the tubular mount access cap **105*b* is first removed. Reaching into and through the tubular mount, the forward wing locking cap 104*i* can then be grasped and twisted so as to remove it from the threaded end of swivel-lock through-tube 104*d*. In like fashion, the aft tubular mount access cap 115*b*, and aft wing locking cap 114*i* can also be removed. At this point, upward and aft-directed force can be applied to the elevated support rail so as to slowly lift the outboard wing structure while moving it slightly aft. The lifting action will cause the outboard 45° male/female tubular fitting 104*a* to rotate on the axis provided by the swivel-lock through-tube 104*d*. Swivel-lock teeth are angled so as to spiral together when interlocking or spiral apart when separating. As a result, the rotation caused by lifting the elevated support rail will accompany a separation of swivel-lock halves, as shown by FIG. 1D, as well as an aft-directed displacement of the outboard wing structure that is equivalent to the height of the swivel-lock teeth. Once the swivel-lock halves are separated to the extent shown by FIG. 1D, the outboard wing structure is be pivoted inboard and the swivel-lock halves are re-engaged by applying a small opposite rotational movement, in combination with a forward push on the wing structure. Once in this position, the wing structure may be released, and frictional force between opposing swivel-lock teeth will prevent the wing from rotating further inboard. Forward and aft wing locking caps 104*i* and 114*i* are then re-installed, along with forward and aft tubular mount access caps 105*b* and 115*b*, resulting in the stowed condition shown by FIG. 1B**.

The slide-in/slide-out stowage deployment method of embodiment 2 is described with respect to FIG. 2A showing the deployed position. In preparation for trailering, and following the detachment of the trap seat and cooler, the forward inner mounting tube expanding plug 209 is removed. Following this, the forward inner mounting tube ring nut 208 is removed. In like fashion, the aft inner mounting tube expanding plug 229, and aft inner mounting tube ring nut 228 are removed. At this point wing structure is grasped by the midpoint of its main extension tube and pulled outboard. This causes the forward and aft inner mounting tubes 207 and 227 to slide outboard until they are fully removed from the forward and aft support arm mounts 322 and 321, respectively. The opposite side wing is then removed in similar fashion, and both wings are re-inserted in the opposite side tubular mounts, except with the formerly outboard structure of each wing now facing inboard. Forward and aft inner mounting tube ring nuts 208 and 228 are then re-installed, along with forward and aft expanding plugs 209 and 229, resulting in the stowed condition shown by FIG. 2B.

What is claimed is:

1. In a small catamaran sailboat, an outboard-projecting elevated attachment comprising:

(a) a main extension tube comprising an elongated hollow cylinder having a wall of substantially rigid material, said main extension tube having a midpoint along its longitudinal axis, a portion forward of said midpoint, and a portion aft of said midpoint, (b) an elevated support rail comprising said main extension tube, forward-disposed attachment means, and aft-disposed attachment means, said forward-disposed attachment means connecting to said portion forward of said midpoint of said main extension tube, and said aft-disposed attachment means connecting to said portion aft of said midpoint of said main extension tube, said elevated support rail having a storage-access end and a far-end opposite said storage-access end, (c) a cylindrical storage volume circumferentially bounded by the cylindrical wall of said main extension tube, said cylindrical storage volume bounded at one end by said storage-access end of said elevated support rail, said cylindrical storage volume extending longitudinally in the direction of said far-end of said elevated support rail, (d) an elevated support rail access cover closing said storage-access end in watertight fashion, the removal of said elevated support rail access cover exposing an aperture of area sufficient to provide substantially unrestricted longitudinal access to said cylindrical storage volume, (e) a forward support arm having an outboard-reaching portion attached to said main extension tube by means of said forward-disposed attachment means, said forward support arm also having an inboard-reaching portion, (f) an aft support arm having an outboard-reaching portion attached to said main extension tube by means of said aft-disposed attachment means, said aft support arm also having an inboard-reaching portion, (g) a forward support arm mount attached to said inboard-reaching portion of said forward support arm, (h) an aft support arm mount attached to said inboard-reaching portion of said aft support arm, (i) forward mounting gear means to secure said forward support arm mount to an existing structural element of said catamaran sailboat at a location substantially above areas frequented by wave action and forward of areas normally occupied by the crew, (j) aft mounting gear means to secure said aft support arm mount to an existing structural element of said catamaran sailboat at a location substantially above areas frequented by wave action and aft of areas normally occupied by the crew, said aft support arm and said forward support arm spaced and having a minimum separation that exceeds the width of two adjacently seated persons of average girth, (k) elevated support rail positioning means comprising said aft mounting gear means, said forward mounting gear means, said aft support arm mount, said forward support arm mount, said aft support arm, and said forward support arm, said elevated support rail positioning means acting to position said elevated support rail so that all points along the longitudinal axis of said elevated support rail are outboard and elevated with respect to existing surfaces usable by a sailor for leveraging against catamaran sailboat heeling force, said elevated support rail thereby providing an advantageously located surface for the application of such leveraging, and improved vertical clearance for the leveraging sailor with respect to occasional water spray, (l) wing closure means to help prevent water flow into said cylindrical storage volume, said wing closure means helping to prevent said water flow by way of said forward-disposed attachment means, by way of said aft-disposed attachment means, and also by way of said far-end of said elevated support rail, said elevated support rail, elevated support rail access cover, and wing closure means thereby providing for a buoyant watertight storage compartment suitable to enhance catamaran sailboat dry storage capacity, said elevated support rail positioning means in combination with said buoyant watertight storage compartment thereby providing leveraged buoyancy helpful for lifting the mast clear of the water during a catamaran sailboat righting operation.

2. The outboard-projecting elevated attachment of claim 1 wherein:

(a) said elevated support rail further comprises an aft extension tube disposed to the rear of said aft-disposed attachment means, said aft extension tube having a wall of substantially rigid material, said aft extension tube sharing the same longitudinal axis as said main extension tube, and said aft extension tube having substantially the same cross-sectional shape and minimum cross-sectional area as said main extension tube, (b) said cylindrical storage volume further comprises an aft cylindrical storage volume disposed within said aft extension tube, the wall of said aft extension tube circumferentially bounding said aft cylindrical storage volume, (c) said aft extension tube has length sufficient to allow a trapezing sailor to apply his weight at a location substantially aft of existing catamaran sailboat surfaces usable for leveraging against catamaran sailboat forward pitching force, said aft extension tube thereby providing an advantageously located surface for such leveraging.

3. The outboard-projecting elevated attachment of claim 2 wherein said aft-end attachment means comprises a tubular T-fitting, said tubular T-fitting having an inboard-facing end attaching to said aft support arm, a rearward-facing end attaching to said aft extension tube, and a forward-facing end attaching to said main extension tube.

4. The outboard-projecting elevated attachment of claim 1, further comprising a storage tray wherein:

(a) said storage tray comprises an elongated tube with a longitudinal access slot cut along a substantial portion of its length, said access slot having sufficient width to permit insertion of items along the length of said storage tray, said storage tray walls having sufficient area to reduce frictional contact of said stored items with said elevated support rail thereby preventing substantial movement of said stored items as said storage tray is inserted in or withdrawn from said elevated support rail, (b) said storage tray is shaped to substantially occupy said cylindrical storage volume upon insertion of said storage tray into said elevated support rail by way of said elevated support rail storage-access end, (c) said storage tray allows limited compression of soft stored items during insertion into said cylindrical storage volume, said compression causing the width of said longitudinal slot to be reduced.

5. The outboard-projecting elevated attachment of claim 1, further comprising a trap seat, wherein said trap seat comprises;

(a) a sheet of flexible material having an upper edge, a lower edge, a forward edge, and an aft edge, (b) means for removably attaching said upper edge of said flexible material to said main extension tube, (c) an elongated trap seat anchor rail member constructed of substantially rigid material, (d) means for attaching said lower edge of said trap seat to said trap seat anchor rail, and (e) means for securing said trap seat anchor rail to said catamaran sailboat.

6. The outboard-projecting elevated attachment of claim 5, wherein said trap seat anchor rail comprises an insulated storage tube or cooler tube;

(a) said cooler tube comprising an elongated hollow cylinder having a wall of substantially rigid material, (b) said cooler tube having a cooler tube storage-access end and a removable cooler tube access cover providing watertight closure at said cooler tube storage-access end, (c) said cooler tube having a cooler tube far-end opposite said cooler tube storage-access end and a sealing means providing watertight closure at said cooler tube far-end, (d) the cylindrical wall of said cooler tube circumferentially encased by a layer of insulating padding, said layer of insulating padding providing thermal insulation for cooler tube contents and a resilient seating surface for improved trap seat comfort, (e) said cooler tube having a retrieval means for drawing stored items out of said cooler tube by way of said cooler tube storage-access end, (f) said trap seat indents to form a secure concave shape under the load of a seated occupant allowing the legs of said seated occupant to extend inboard, said cooler tube forming the inboard lip of said concave shape preventing said seated occupant from sliding inboard as the catamaran reaches an optimum heeling attitude associated with peak performance, (g) said cooler tube and trap seat providing a seating surface raised above existing seating means provided by said catamaran for a seated occupant, said cooler tube and trap seat thereby separating said seated occupant from water that splashes onto said catamaran sailboat's above-deck areas and flows into the vicinity of said existing seating means.

7. The outboard-projecting elevated attachment of claim 6, wherein said retrieval means comprises a retrieve strap and a movable object or pull cylinder that is located within said cooler tube, said retrieve strap having an end attached to said access cover and an opposite end extending into said cooler tube and connecting to said pull cylinder, stored items inserted into said cooler tube storage-access end thereby causing said pull cylinder and attached retrieve strap to be forced into said cooler tube, tension applied to said retrieve strap thereby drawing said pull cylinder toward said cooler tube storage-access end, ejecting said stored items in their reverse order of entry.

8. The outboard-projecting elevated attachment of claim 1, wherein:

(a) said aft support arm mount comprises a hollow cylinder having a tubular wall of substantially rigid material, said aft support arm mount having and outboard facing-end and an inboard-facing end, (b) said forward support arm mount comprises a hollow cylinder having a tubular wall of substantially rigid material, said forward support arm mount having and outboard facing-end and an inboard-facing end, (c) said aft support arm, and said forward support arm are tubular, (d) said aft-disposed attachment means comprises an aft tubular fitting sized for mutual attachment of said aft support arm and said main extension tube, (e) said forward-end attachment means comprises a forward tubular fitting sized for mutual attachment of said forward support arm and said main extension tube, (f) a tubular elevated wing structure comprises said forward support arm, said aft support arm, and said elevated support rail, (g) said inboard-reaching portion of said aft support arm comprises an aft inner mounting tube, said aft inner mounting tube having an inboard-facing open end, (h) said inboard-reaching portion of said forward support arm comprises a forward inner mounting tube, said forward inner mounting tube having an inboard-facing open end, (i) said aft inner mounting tube and said forward inner mounting tube have longitudinal axes that are substantially parallel, (j) said aft support arm mount and said forward support arm mount have longitudinal axes that are substantially parallel, (k) said aft inner mounting tube and said forward inner mounting tube are spaced and diametrically sized for smooth, simultaneous insertion whereby said aft inner mounting tube is inserted into said aft support arm mount and said forward inner mounting tube is inserted into said forward support arm mount, said simultaneous insertion provided for by the geometry of said elevated wing structure, and said simultaneous insertion being possible with said elevated wing structure projecting either outboard as in a deployed, configuration or inboard as in a stowed configuration, (l) insertion of said forward inner mounting tube into said forward support arm mount is limited by an increase in forward support arm diameter at the attachment point of said forward inner mounting tube, (m) insertion of said aft inner mounting tube into said aft support arm mount is limited by an increase in aft support arm diameter at the attachment point of said aft inner mounting tube, (n) said elevated support rail positioning means further comprises wing locking means that prevent inadvertent movement of said forward inner mounting tube and said aft inner mounting tube from their respective installed positions in said forward support arm mount and said aft support arm mount, said wing locking means operable with said elevated wing structure installed in its stowed configuration for trailering of said catamaran sailboat, said wing locking means also operable with said elevated wing structure installed in its deployed configuration for normal operation of said catamaran sailboat, (o) said wing closure means comprises a forward removable expanding plug or forward support arm access cap sealing said open end of said forward inner mounting tube, said forward support arm access cap and forward inner mounting tube thereby allowing the internal volume of said forward support arm to be used as a watertight storage space that is readily accessible while sailing, (p) said wing closure means further comprises an aft removable expanding plug or aft support arm access cap sealing said open end of said aft inner mounting tube, said support arm access cap and aft inner mounting tube thereby allowing the internal volume of said aft support arm to be used as a watertight storage space that is readily accessible while sailing.

9. The outboard-projecting elevated attachment of claim 8, wherein:

(a) said wing locking means comprises a forward inner mounting tube ring nut and an aft inner mounting tube ring nut, (b) said forward inner mounting tube has a threaded end and a length exceeding that of said forward support arm mount, the threaded end of said forward inner mounting tube thereby being exposed and projecting inboard when said forward inner mounting tube is fully inserted into said forward support arm mount, (c) said forward inner mounting tube ring nut can be threadedly engaged with the exposed and threaded end of said forward inner mounting tube, thereby preventing substantial motion of said forward inner mounting tube with respect to said forward support arm mount, (d) said aft inner mounting tube has a threaded end and a length exceeding that of said aft support arm mount, the threaded end of said aft inner mounting tube thereby being exposed and projecting inboard when said aft inner mounting tube is fully inserted into said aft support arm mount, (e) said aft inner mounting tube ring nut can be threadedly engaged with the exposed and threaded end of said aft inner mounting tube, thereby preventing substantial motion of said aft inner mounting tube with respect to said aft support arm mount.

10. The outboard-projecting elevated attachment of claim 8, wherein:

(a) said aft tubular fitting comprises a tubular T-fitting, said elevated support rail further comprising an aft extension tube, said aft extension tube extending rearward from said tubular T-fitting, said main extension tube attaching at a forward facing end of said tubular T-fitting, and said aft support arm attaching to an inboard-facing end of said tubular T-fitting, (b) said aft extension tube allows a trapezing sailor to apply his weight at a location substantially outboard, elevated, and aft with respect to existing catamaran sailboat surfaces usable by the sailor for leveraging against the combined effect of catamaran sailboat heeling and forward pitching force, said aft extension tube thereby providing an advantageously located surface for such leveraging.

11. The outboard-projecting elevated attachment of claim 1, wherein said forward support arm mount comprises a tubular, hollow cylinder having a wall of substantially rigid material, and said forward mounting gear means comprises;

(a) an inboard mounting strut and an outboard mounting strut, each having an upper end and a lower end, the upper ends of said inboard mounting strut and said outboard mounting strut shaped so as to conform to the tubular wall of said forward support arm mount, said inboard mounting strut having a predominantly inboard-facing surface and a predominantly outboard-facing surface, said outboard mounting strut also having a predominantly inboard-facing surface and a predominantly outboard facing surface, said existing structural element of said catamaran sailboat sandwiched between the lower ends of said inboard mounting strut and said outboard mounting strut, (b) a lower through bolt assembly penetrating said lower end of said inboard mounting strut, said lower end of said outboard mounting strut, and said existing structural element sandwiched there between, (c) mounting strut upper attachment means comprising an upper through bolt assembly, said upper through bolt assembly located substantially above said lower through bolt assembly, said upper through bolt assembly penetrating said inboard mounting strut and said outboard mounting strut, said lower through bolt assembly and said upper through bolt assembly acting to clamp said inboard mounting strut and said outboard mounting strut about said existing structural element of said catamaran sailboat, (d) an inboard cable anchor bolt having a longitudinal axis parallel to the longitudinal axis of said forward support arm mount, said inboard mounting strut having a guide hole accommodating said inboard, cable anchor bolt, said inboard cable anchor bolt extending through said guide hole and thereby having an end projecting from said predominantly inboard-facing surface of said inboard mounting strut and an opposite end projecting from said predominantly outboard-facing surface of said inboard mounting strut, said guide hole being elongated so as to allow movement of said inboard cable anchor bolt in a direction perpendicular to its longitudinal orientation, said movement of said inboard cable anchor bolt being substantially directed along a radial line extending from the longitudinal axis of said forward support arm mount, (e) an inboard set screw projecting from said upper end of said inboard mounting strut, said inboard set screw having a longitudinal axis substantially oriented along a radial line extending from the longitudinal axis of said forward support arm mount, said forward support arm mount having a first hole in its tubular wall, said inboard set screw having an upper end accessible by means of said guide hole in the tubular wall of said forward support arm mount, said forward support arm mount having sufficient internal space so as to allow said inboard set screw to be adjusted, said inboard set screw having a lower end projecting into said guide hole of said inboard mounting strut and bearing perpendicularly upon the shaft of said inboard cable anchor bolt, said inboard set screw thereby serving to adjust the position of said inboard cable anchor bolt within said guide hole, (f) an inboard hold-down cable assembly attaching to said inboard cable anchor bolt end projecting from said predominantly inboard-facing side of said inboard mounting strut, said inboard hold-down cable assembly then wrapping over said forward support arm mount, and attaching to said inboard cable anchor bolt end projecting from said predominantly outboard-facing side of said inboard mounting strut, adjustment of said inboard set screw and corresponding movement of said inboard cable anchor bolt thereby causing said inboard hold-down cable assembly to be tensioned, (g) an outboard cable anchor bolt having a longitudinal axis parallel to the longitudinal axis of said forward support arm mount, said outboard mounting strut having a guide hole accommodating said outboard cable anchor bolt, said outboard cable anchor bolt extending through said guide hole and thereby having an end projecting from said predominantly inboard-facing surface of said outboard mounting strut and an opposite end projecting from said predominantly outboard-facing surface of said outboard mounting strut, said guide hole being elongated so as to allow movement of said outboard cable anchor bolt in a direction perpendicular to its longitudinal orientation, said movement of said outboard cable anchor bolt being substantially directed along a radial line extending from the longitudinal axis of said forward support arm mount, (h) an outboard set screw projecting from said upper end of said outboard mounting strut, said outboard set screw having a longitudinal axis substantially oriented along a radial line extending from the longitudinal axis of said forward support arm mount, said forward support arm mount having a second hole in its tubular wall, said outboard set screw having an upper end accessible by means of said second hole in the tubular wall of said, forward support arm mount, said forward support arm mount having sufficient internal space so as to allow said outboard set screw to be adjusted, said outboard set screw having a lower end projecting into said guide hole of said outboard mounting strut and bearing perpendicularly upon the shaft of said outboard cable anchor bolt, said outboard set screw thereby serving to adjust the position of said outboard cable anchor bolt within said guide hole, (i) an outboard hold-down cable assembly attaching to said outboard cable anchor bolt end projecting from said predominantly inboard-facing side of said outboard mounting strut, said outboard hold-down cable assembly then wrapping over said forward support arm mount, and attaching to said outboard cable anchor bolt end projecting from said predominantly outboard-facing side of said outboard mounting strut, adjustment of said outboard set screw and corresponding movement of said outboard cable anchor bolt thereby causing said outboard hold-down cable assembly to be tensioned.

12. The outboard-projecting elevated attachment of claim 11, wherein said aft mounting gear means and said forward mounting gear means are similarly comprised.

13. The outboard-projecting elevated attachment of claim 1, wherein said aft support arm mount, said forward support arm mount, said aft support arm, said forward support arm, said aft-disposed attachment means, and said forward-disposed attachment means are tubular, and wherein;

(a) said aft support arm mount and said inboard-reaching portion of said aft support arm are solidly joined, (b) said inboard-reaching portion of said aft support arm comprises an aft swivel-lock fixed-half, said aft swivel-lock fixed-half having a fixed-elbow part and a fixed-interlock part, said fixed-elbow part joined inboard to said aft support arm mount and joined outboard to said fixed-interlock part, said fixed-interlock part having a cylindrically circular aspect and being aligned by said fixed-elbow part so as to have a longitudinal axis substantially parallel to the direction of sailboat travel, (c) said outboard-reaching portion of said aft support arm comprises an aft swivel-lock movable-half and an aft arm tube, said aft swivel-lock movable-half having a movable-elbow part, and a movable-interlock part having a cylindrically circular aspect, said movable-interlock part being longitudinally aligned and removably attached to said fixed-interlock part, said movable-elbow part joined inboard to said movable-interlock part and joined outboard to said forward arm tube, (d) an aft swivel-lock assembly comprises said aft swivel-lock fixed-half and said aft swivel-lock movable-half, (e) said forward support arm mount and said inboard-reaching portion of said forward support arm are solidly joined, (f) said inboard-reaching portion of said forward support arm comprises a forward swivel-lock fixed-half, said forward swivel-lock fixed-half having a fixed-elbow portion and a fixed-interlock portion, said fixed-elbow portion joined inboard to said forward support arm mount and joined outboard to said fixed-interlock portion, said fixed-interlock portion aligned by said fixed-elbow portion so as to have a longitudinal axis substantially parallel to the direction of sailboat travel, (g) said outboard-reaching portion of said forward support arm comprises a forward swivel-lock movable-half and a forward arm tube, said forward swivel-lock movable-half having a movable-elbow portion, and a movable-interlock portion having a cylindrically circular aspect, said movable-interlock portion being longitudinally aligned and removably attached to said fixed-interlock portion, said movable-elbow portion joined inboard to said movable-interlock portion and joined outboard to said forward arm tube, (h) a forward swivel-lock assembly comprises said forward swivel-lock fixed-half and said forward swivel-lock movable-half, (i) an elevated wing structure comprises said aft swivel-lock movable-half, said forward swivel-lock movable-half, said aft arm robe, said forward arm tube, and said elevated support rail, (j) said aft swivel-lock assembly comprises aft through-tube means and aft interlocking teeth means, said aft through-tube means providing an aft-disposed axis of rotation for said outboard-reaching portion of said aft support arm and providing alignment as said aft swivel-lock movable-half and said aft swivel-lock fixed-half are joined, (k) said forward swivel-lock assembly comprises forward through-tube means and forward interlocking teeth means, said forward, through-tube means providing a forward-disposed axis of rotation for said outboard-reaching portion of said forward support arm and providing alignment as said forward swivel-lock movable-half and said forward swivel-lock fixed-half are joined, (l) said aft-disposed axis of rotation and said forward-disposed axis of rotation are longitudinally aligned and thereby provide a common axis of rotation for said elevated wing structure, (m) said elevated wing structure is movable in a longitudinal direction along said common axis of rotation, said aft through-tube means and said forward through tube means having sufficient length to provide said common axis of rotation and at the same time accommodate a measured displacement of said elevated wing structure, said measured displacement being sufficient to simultaneously disengage said forward interlocking teeth means and said aft interlocking teeth means, said elevated wing structure thereby being pivotable to a deployed configuration whereby said elevated wing structure is disposed outboard, or a stowed configuration whereby said elevated wing structure is not substantially disposed outboard, said forward interlocking teeth means and said aft interlocking teeth means subject to re-engagement by a movement opposite to said measured displacement, said re-engagement serving to orient said elevated wing structure in a desired deployed or stowed configuration, (n) said elevated support rail positioning means further comprises wing locking means that prevent inadvertent disengagement of said aft interlocking teeth means or of said forward interlocking teeth means, said wing locking means operable with said elevated wing structure pivoted to its stowed configuration for trailering of said catamaran sailboat, said wing locking means also operable with said elevated wing structure pivoted to its deployed configuration for normal operation of said catamaran sailboat.

14. The outboard-projecting elevated attachment of claim 13, wherein;

(a) said movable-interlock portion of said aft swivel-lock movable-half comprises through-tube means disposed in an inner concentric cylinder and locking teeth means disposed in an outer concentric cylinder, (b) said fixed-interlock portion of said aft swivel-lock fixed-half comprises through-tube receptacle means disposed in an inner concentric cylinder and locking teeth means disposed in an outer concentric cylinder, (c) said movable-interlock portion of said forward swivel-lock movable-half comprises through-tube means disposed in an inner concentric cylinder and locking teeth means disposed in an outer concentric cylinder, (d) said fixed-interlock portion of said forward swivel-lock fixed-half comprises through-tube receptacle means disposed in an inner concentric cylinder and locking teeth means disposed in an outer concentric cylinder.

15. The outboard-projecting elevated attachment of claim 14, wherein;

(a) said through-tube means of said aft swivel-lock movable-half comprises an aft swivel-lock through tube, and inner end cap, and a wing locking cap, said swivel-lock movable-half, said swivel-lock through tube, and said inner end cap being solidly joined so as to prevent intrusion of water into said outboard-reaching portion of said aft support arm, (b) said through-tube receptacle means of said aft swivel-lock fixed-half comprises an inboard swivel-lock inner liner ring sized for snug accommodation of said aft-swivel lock through-tube, said aft swivel-lock through-tube having a threaded-end and length sufficient to pass through and extend beyond said inner liner ring, thereby exposing said threaded end, (c) said wing locking means comprise wing-locking cap, said wing locking means being effected by threaded engagement of said wing locking cap onto said threaded-end of said aft swivel-lock through-tube, said wing locking cap thereby preventing disengagement of said aft swivel-lock through-tube and said aft swivel-lock inner liner ting, said wing locking cap, said through-tube, and said inner end cap also providing a cubby hole storage space for secure storage of infrequently-accessed items, (d) said movable-interlock portion of said forward swivel-lock movable-half and said movable-interlock portion of said aft swivel-lock movable-half are similarly comprised, (e) said fixed-interlock portion of said forward swivel-lock fixed-half and said fixed-interlock portion of said aft swivel-lock fixed-half are similarly comprised.

16. In a small catamaran sailboat incorporating an outboard-projecting elevated attachment, said outboard-projecting elevated attachment having surfaces accommodating the leveraging of a substantial portion of a helmsman's weight against sailboat heeling force, said small catamaran sailboat further incorporating two tillers interconnected by a tiller crossbar, said tiller crossbar having a midpoint and tiller attachment means symmetrically disposed about said midpoint, the improvement comprising;

(a) a filler extension pole having an inboard-reaching portion and outboard-reaching portion, said outboard-reaching portion having a shaft-section supported by said outboard-projecting elevated attachment at a preferred guide location conveniently situated near accommodations provided for said helmsman of said catamaran sailboat, said inboard reaching-portion secured to said tiller crossbar by means of a pivotable attachment joint, said preferred guide location and said pivotable attachment joint being separated by a distance which is smaller than that separating said preferred guide location and said midpoint of said tiller crossbar, (b) a filler extension pole guide comprising a member that projects outward from said elevated support rail at a point immediately aft of said preferred guide location, said tiller extension pole guide thereby blocking aft-directed movement of said filler extension pole from said preferred guide location, said tiller extension pole guide providing for an opening allowing removal of said tiller extension pole from said preferred guide location, said tiller extension pole guide further incorporating tiller extension pole detent means serving to restrict the geometry of said opening, said filler extension pole detent means thereby allowing said tiller extension pole to be controllably accepted by, retained in, and released from said tiller extension pole guide, (c) filler extension pole catch means, said catch means activated manually and serving to engage said tiller extension pole and said tiller extension pole guide so as to restrict movement of said tiller extension pole, said catch means being releasable by moving said tiller extension pole along its longitudinal axis in the direction of said pivotable attachment joint, said catch means normally engaged at the initiation of a tacking process, and normally remaining engaged as said helmsman moves laterally across said catamaran sailboat during the performance of said tacking process, said tiller extension pole being operated in combination with an opposite-side tiller extension pole, said tiller extension pole and said opposite-side tiller extension pole being similarly comprised, manual disengagement of said catch means normally accomplished by said helmsman after moving laterally across said catamaran and during a concluding stage of said tacking process, said helmsman typically accomplishing said manual disengagement by applying a pulling force to said opposite-side tiller extension pole.

17. In a small catamaran sailboat, an outboard-projecting elevated attachment comprising:

(a) a tubular elevated support rail comprising a cylindrical wall structure that circumferentially bounds a storage volume in watertight fashion, (b) a watertight removable cover located at an end of said tubular elevated support rail, providing longitudinal access to the contents of said storage volume, (c) means for preventing entry of water through the end of said tubular elevated support rail opposite to said removable cover, thereby providing in combination with said tubular elevated support rail and removable cover, a buoyant watertight storage compartment suitable to enhance said catamaran sailboat's dry storage capability, (d) means for securely positioning said tubular elevated support rail to a location outboard and elevated with respect to existing surfaces usable by a sailor for leveraging against sailboat heeling force, said tubular elevated support rail thereby providing an advantageously located surface for the effective application of such leveraging, improved vertical clearance for the leveraging sailor with respect to occasional water spray, and beneficially leveraged buoyancy helpful for lifting the mast clear of the water during a catamaran sailboat righting operation.

* * * * *